US005392858A

United States Patent [19]

Peters et al.

[11] Patent Number: 5,392,858

[45] Date of Patent: Feb. 28, 1995

[54] MILLING APPARATUS AND METHOD FOR WELL CASING

[75] Inventors: Alan D. Peters, Midland; Randolph A. Busch, Sugarland; Robert W. McQueen, Granbury; Thomas A. Huddle, Katy; Ronald E. Cherry, Kingwood, all of Tex.

[73] Assignee: Penetrators, Inc., Midland, Tex.

[21] Appl. No.: 227,885

[22] Filed: Apr. 15, 1994

[51] Int. Cl.[6] ..... E21B 43/112; E21B 7/18

[52] U.S. Cl. ..... 166/298; 166/55.1; 175/62; 175/67

[58] Field of Search ..... 166/297, 298, 55, 55.1, 166/55.2, 55.8; 175/62, 67, 267

[56] References Cited

U.S. PATENT DOCUMENTS 4,640,362 2/1987 Schellstede ..... 166/298

5,183,111 2/1993 Schellstede ..... 166/298

*Primary Examiner*—William P. Neuder

*Attorney, Agent, or Firm*—Popham, Haik, Schnobrich & Kaufman, Ltd.

[57] ABSTRACT

A well penetrator consists of a number of hydraulic fluid control components and a carriage carrying a hydraulic motor and a mill bit supported in a housing which is moveable down a well casing. The control components cause the carriage carrying the mill bit to be indexed up a predetermined distance relative to the well casing and then extended gradually into contact with the well casing while being rotated by the hydraulic motor. After the mill bit completes a hole through the well casing, the hydraulic components index the mill bit back down to its starting position and align a nozzle on the outer end of a high pressure lance with the opening in the casing to direct fluid from the nozzle as the lance is moved outwardly through the hole in the casing drilled by the mill bit.

24 Claims, 14 Drawing Sheets

FIG. 2C
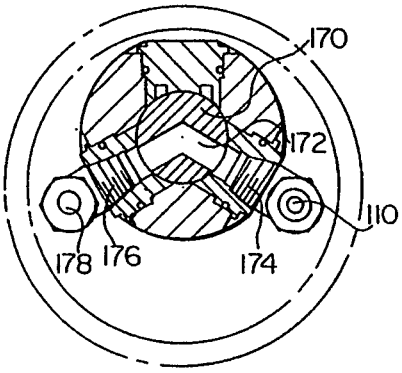
FIG. 2E
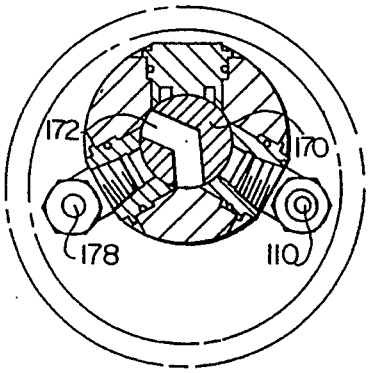
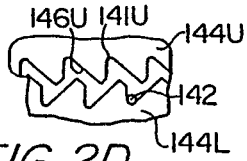
FIG. 2D
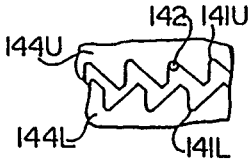
FIG. 2F
FIG. 2G
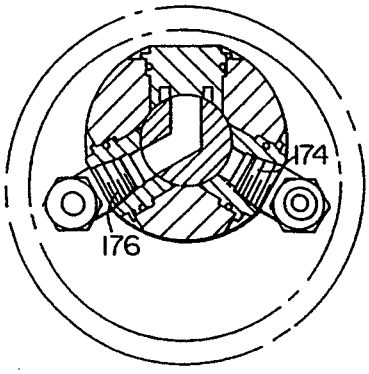
FIG. 2I
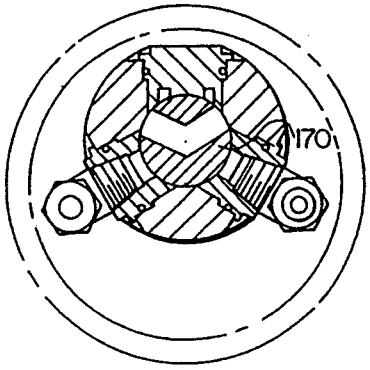
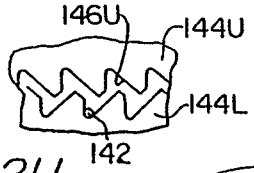
FIG. 2H
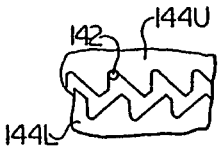
FIG. 2J
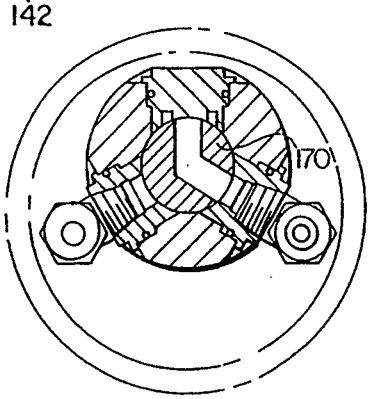
FIG. 2K
FIG. 2L
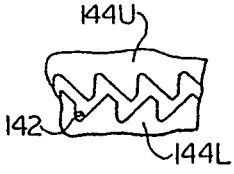

MILLING APPARATUS AND METHOD FOR WELL CASING

BACKGROUND OF THE INVENTION

1. Field of the Invention

The present invention relates to the field of oil and/or gas well casing perforation apparatus, procedures and methods. More specifically, the invention relates to a unique apparatus and method employing a hydraulic motor driven mill bit for cutting an opening in a well casing to permit the subsequent cutting of a passageway through the surrounding earth by the use of a high pressure jet lance movable through the opening for a substantial distance outwardly beyond the casing for permitting the flow of liquid or gaseous hydrocarbons into the casing.

A contaminated zone is typically formed around the well bore as a result of drilling fluids used during the drilling operation, and also as a result of the cement which is typically forced down into the bottom of a well bore and up into the annular cavity between the well casing the completed well bore. This contaminated zone frequently presents a substantial barrier to the inflow of hydrocarbons to the well casing.

A number of expedients have been proposed and employed in an effort to provide flow passageways through the surrounding strata for permitting and increasing the flow of hydrocarbons into the well casing.

U.S. Pat. Nos. 4,790,384 and 5,107,943 show a method employing a cam drive cylinder means for driving a wedging cam to extend a radially movable punch outwardly through the casing of a well. Another common expedient for effecting casing and formation penetration is the use of projectiles fired from gun-like devices positioned in the casing.

Other U.S. patents have shown separate mechanical cutting devices that are lowered to the bottom of the well, operated to cut a hole through the well casing and subsequently removed from the well casing in order to permit the lowering and positioning of a jet means in the casing for subsequent usage of the nozzle jet-type cutter to cut into the surrounding formation. The positioning and removal of tools such as cutting devices to and from the well normally requires a time consuming and expensive pulling and replacement of the pipe string extending above the tooling. With this method it is also difficult to precisely locate the opening created by the mechanical cutting device at a deep well depth after the cutting device has been removed from the well. The foregoing problem is of substantial significance since the jet-type cutter must be accurately positioned adjacent the opening in order to function.

In the previous patents disclosing a radially movable punch for penetrating through the well casing, the nozzle extension device or lance which moved axially outwardly through an axial bore in the punch and therefore radially relative to the well casing, was forced to make a sharp 90° turn in order to exit from the axial bore through the punch. The resulting small bend radius for the lance necessitated a relatively flexible lance having a relatively small inner diameter. As a result, an undesirable pressure drop occurred through the lance. Furthermore, the wedging mechanism required in these previous patents was very heavy and expensive to build. Another inherent disadvantage of some of the prior art devices is a result of the reaction force created on the punch of the type shown in U.S. Pat. No. 5,107,943 during the penetration of the well casing. This reaction force is of sufficient magnitude to require a back up plate as a part of the down hole apparatus which fits closely to the inner diameter of the well casing. This requirement for a close fit between the down hole apparatus and the well casing can interfere with the ability to locate the down hole apparatus at the proper depth if the well casing has any inside diameter restrictions. Another inherent disadvantage of the methods shown in previous U.S. patents is a lack of reliable means for monitoring the progress of drilling or punching operations being performed at the base of a well bore.

SUMMARY OF THE INVENTION

The preferred embodiment for practice of the invention comprises an elongated, generally cylindrical housing capable of being lowered down a well casing and having control means for providing pressurized working hydraulic fluid to a hydraulic motor which operates a rotary mill bit through a right angle drive, a mill bit piston, and a spline assembly that allows for the simultaneous rotation and axial reciprocation of the mill bit. Control components are provided for assuring that whenever the hydraulic motor is running it is also moved vertically upward a predetermined distance to an index up position adjacent a desired through-hole location on the well casing. The control components also assure that the mill bit is only extended radially relative to the well casing into contact with the well casing when located at the index up position and that the mill bit is extended at a controlled feed rate in order to prevent tool breakage or stalling of the hydraulic motor.

More specifically, a carriage assembly supports the hydraulic motor, right angle drive, mill bit piston, spline assembly, and lance guide. An index cylinder assembly comprising a group of three cylinders controls the vertical position of the carriage assembly. Two small hydraulic cylinders are pressure biased to hold the carriage assembly in an index down position whenever pressure is supplied to the control components. A large hydraulic cylinder overpowers the small hydraulic cylinders and pulls the carriage assembly to an index up position whenever pressure is provided to a line that supplies both the hydraulic motor and the large hydraulic cylinder. The index cylinder assembly solves the problem of having to remove the mechanical cutting device after it has cut a hole through the well casing and of then having to lower a lance assembly into the well casing and experimentally determine when the lance is positioned adjacent the completed hole. A further advantage of the present invention is provided by the feature of the hydraulic motor and mill bit being mounted on the carriage assembly along with a lance guide tube as part of a single down hole apparatus. The hydraulic motor and mill bit are located in the index down position whenever the control components shut off flow to the motor and to the large index up hydraulic cylinder. Therefore, a detected flow rate of pressurized hydraulic working fluid at the surface indicates that the motor is running and is necessarily located in the index up position and ready to extend the mill bit to drill a hole through the well casing.

Retraction of the mill bit from the hole drilled through the well casing prior to indexing the carriage assembly down to the index down position is necessary in order to avoid breaking the mill bit. This step is assured by the feature of a two position spool valve that exhausts pressure from the extend side of the mill bit piston after the drilling operation is completed and while the control pressure is still higher than the pressure necessary to activate the large index up hydraulic cylinder; thereby exhausting pressure from the extend side of the mill bit piston while the large index up hydraulic cylinder is still activated.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which:

FIG. 2C is a sectional view similar to FIG. 2A showing the sequence valve ball in a second position with communication provided between the sequence valve inlet and outlet ports.

FIG. 2D is a view similar to FIG. 2B illustrating the location of the sequence valve pin in the cam sleeve in the position which it moves to from the FIG. 2B position to effect movement of the sequence valve ball to the position shown in FIG. 2C.

FIG. 2E is a view similar to FIG. 2C showing the sequence valve ball in a third position.

FIG. 2F shows the location of the sequence valve pin in the cam sleeve when the sequence valve ball is in the position shown in FIG. 2E.

FIG. 2G is a view similar to FIG. 2E showing the sequence valve ball in a fourth position.

FIG. 2H is a view similar to FIG. 2F illustrating the valve pin position in the cam sleeve when the sequence valve ball is in the fourth position shown in FIG. 2G.

FIG. 2I is a sectional view similar to FIG. 2A showing the sequence valve ball in a fifth position.

FIG. 2J shows the location of the sequence valve pin in the cam sleeve when the sequence valve ball is in the position shown in FIG. 2I.

FIG. 2K is a sectional view similar to FIG. 2A showing the sequence valve ball in a sixth position.

FIG. 2L shows the location of the sequence valve pin in the cam sleeve when the sequence valve ball is in the position shown in FIG. 2K.

DETAILED DESCRIPTION OF THE PREFERRED EMBODIMENTS

Figure 1:
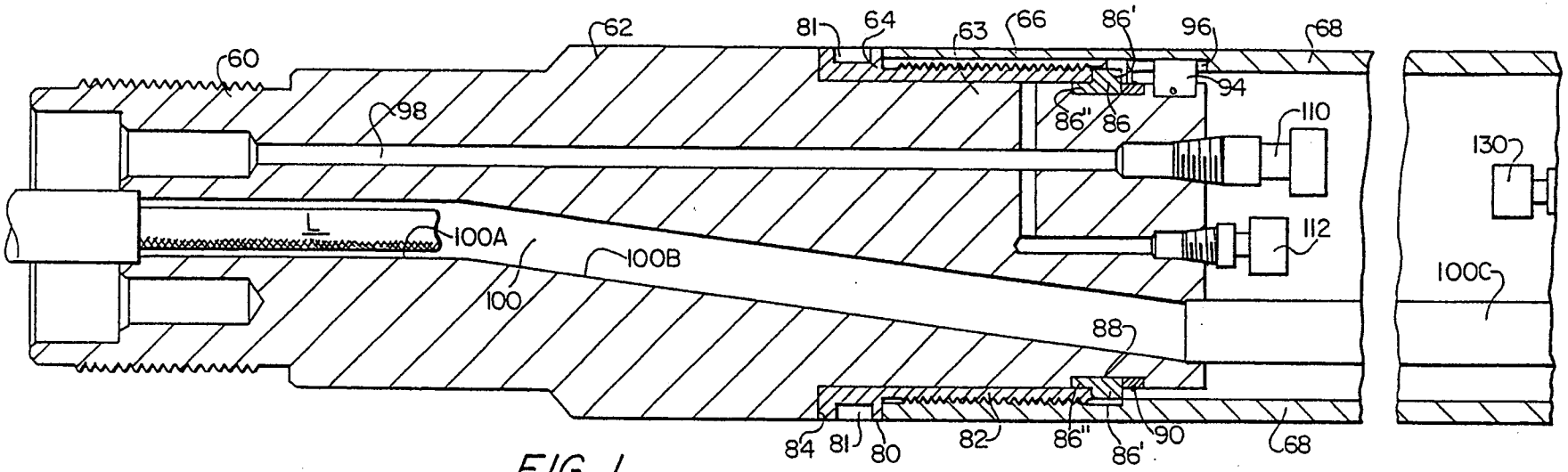
FIG. 1 is a longitudinal sectional view of the valve section upper sub and the upper end of the valve section housing.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Figure 10:
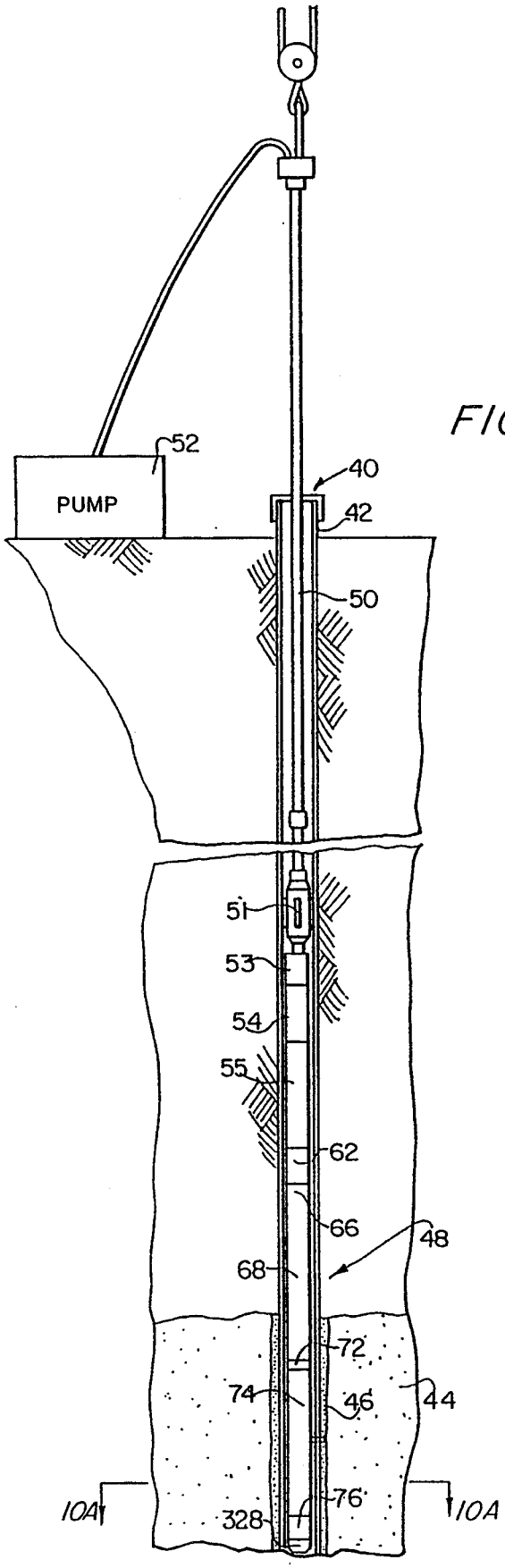
FIG. 10 is a front elevation view showing a gas or oil well in vertical section and showing a manner of employment of the inventive apparatus and method.
Figure 10A:
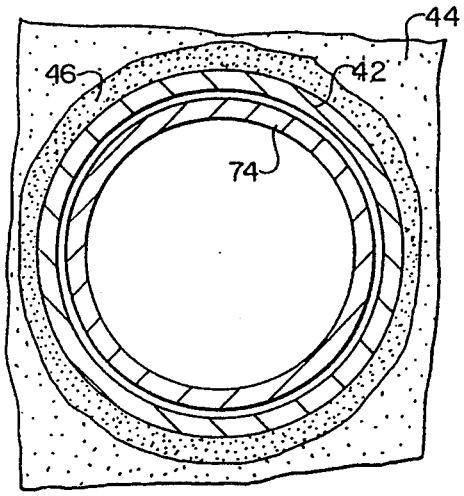
FIG. 10A is a sectional view taken along lines 10A—10A in FIG. 10.

Referring initially to FIG. 10 of the drawings, a preferred embodiment of the invention is shown in an oil well 40 having a casing 42 extending downwardly through an oil bearing strata 44. A contaminated zone 46 extends outwardly around casing 42 and comprises drilling mud constituents forced into oil bearing strata 44 during the drilling operation. Additionally, the area immediately surrounding casing 42 at the bottom of the oil well will normally include a layer of cement pumped into place at the completion of the well.

The present invention comprises an elongated down-hole apparatus 48 suspended from the surface by a pipe string 50 comprising a plurality of conventional tubular pipe sections with the lowermost pipe section being connected to a stabilizer/anchor 51 as described in U.S. Pat. No. 5,107,943 to McQueen et al., which is herein incorporated by reference. A conventional filter 53 is mounted below stabilizer/anchor 51.

In the following description the upper end of the major components described corresponds to the left side of the longitudinal section views of FIGS. 1, 2, 3, 3B, 3C, 4, 5, 6, 6B, 6C, 7 and 8. The elongated down-hole apparatus 48 is formed of a plurality of connected tubular housing members in which various functions and equipment are provided. As described in U.S. Pat. No. 5,107,943, a control section 54 is provided below filter 53 and is concentric with respect to a vertical axis extending along the length of apparatus 48. A conventional lance section 55 of the type shown in U.S. Pat. No. 4,640,362, which is herein incorporated by reference, is connected to the lower end of control section 54 and has its lower end connected to the externally threaded upper end 60 of a valve section upper sub 62 shown in FIG. 1. Valve section upper sub 62 is connected at its lower end by a special threaded collar 64 (which will be described in detail below) to the upper internally threaded end 66 of a valve section housing 68.

Figure 5:
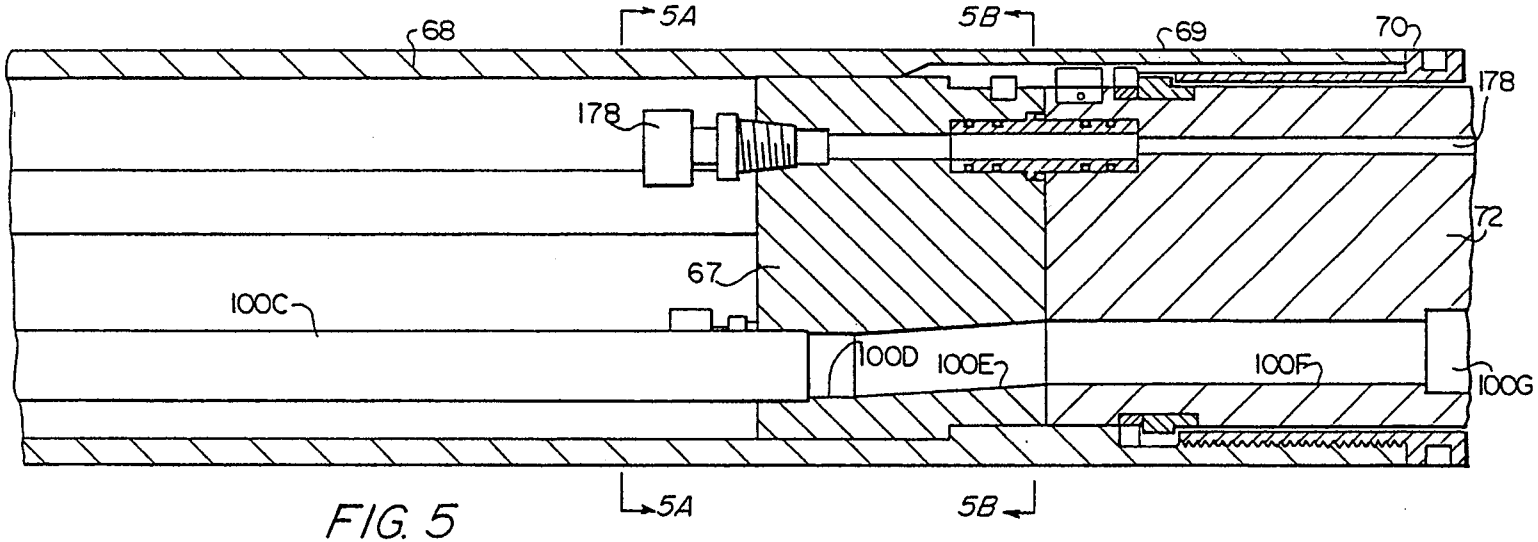
FIG. 5 is a longitudinal sectional view showing the connection between the valve section housing and the intermediate sub.
Figure 6:
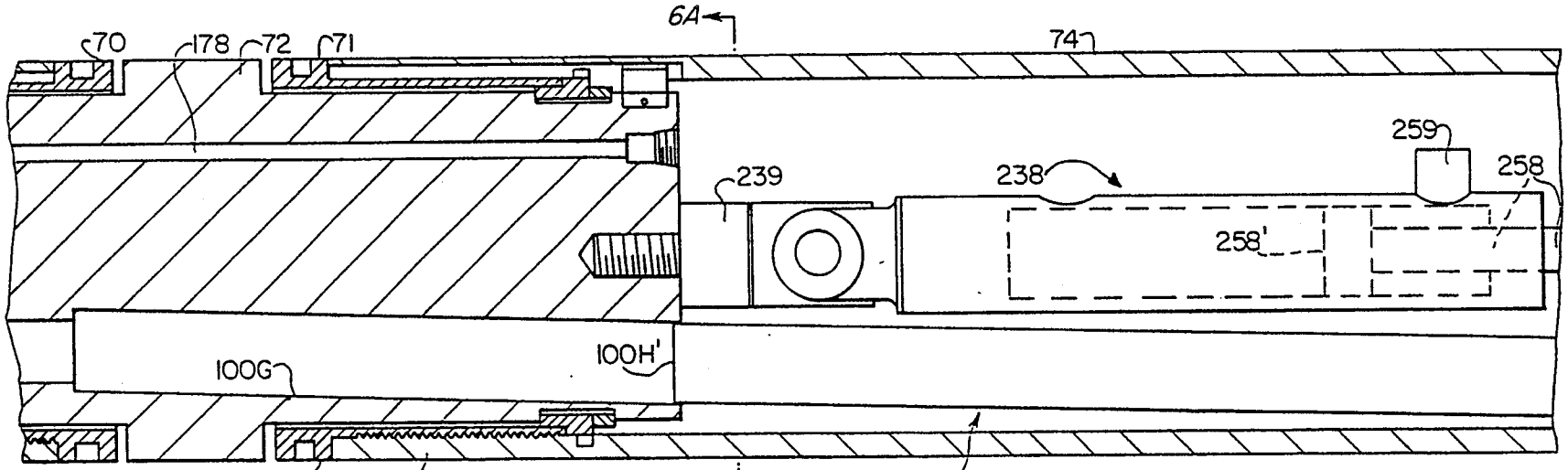
FIG. 6 is a longitudinal sectional view showing the connection between the intermediate sub and the mill section housing.
Figure 8:
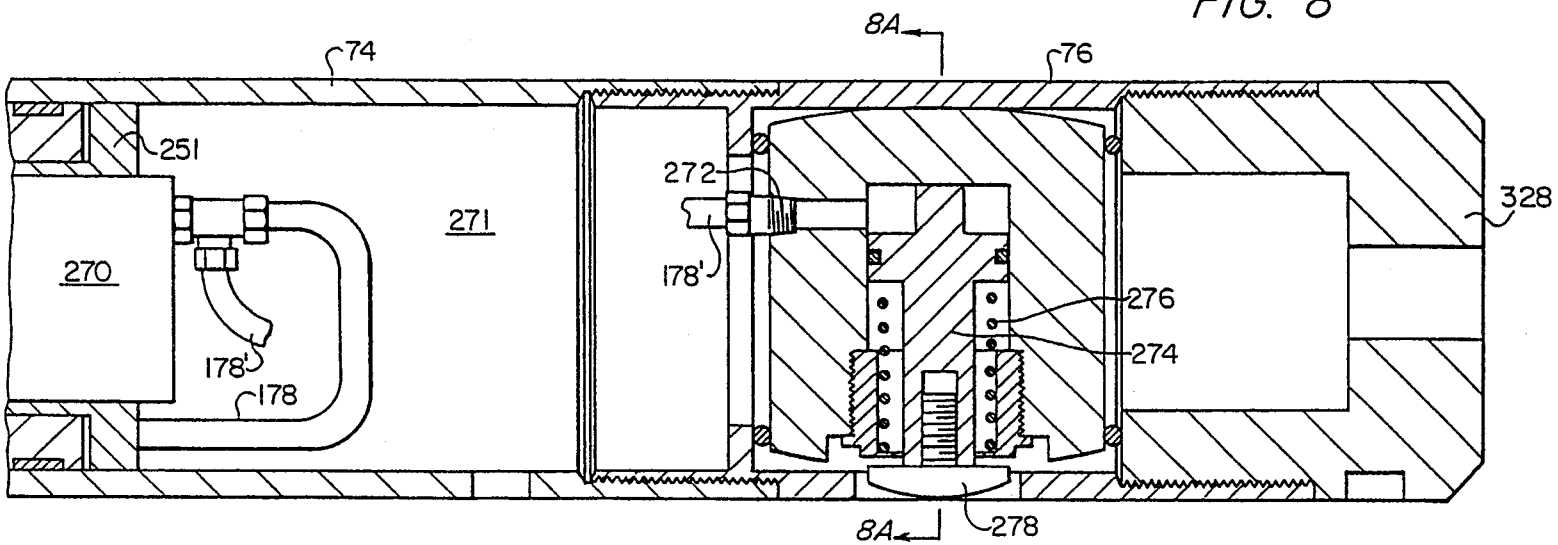
FIG. 8 is a longitudinal sectional view showing the lower end of the mill section housing connected to the kickover assembly and a bull plug.
Figure 8A:
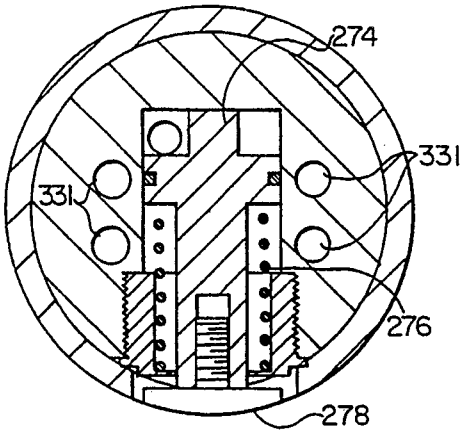
FIG. 8A is a sectional view taken along lines 8A—8A in FIG. 8.

Valve section housing 68 contains a number of control components to be described in detail below, and is connected at its lower end 69 by another threaded collar 70, shown in FIG. 5, to an intermediate sub 72 connecting the lower end 69 of the valve section housing to a mill section housing 74 shown in FIG. 6. Intermediate sub 72 is connected at its lower end by another threaded collar 71, shown in FIG. 6, to mill section housing 74. The mill section housing 74 contains means for drilling radially outwardly through well casing 42 to provide an opening through which a flexible lance L having a nozzle N on its outer end can subsequently be extended. Mill section housing 74 terminates at its lower end in a kickover assembly 76, as shown in FIG. 8.

A detailed description of the manner in which threaded collar 64 connects lower end 63 of valve section upper sub 62 to valve section housing 68 follows. A similar description applies for the connection of valve section housing lower end 69 to intermediate sub 72, as shown in FIG. 5, and the connection of intermediate sub 72 to mill section housing 74, as shown in FIG. 6.

Figure 1A:
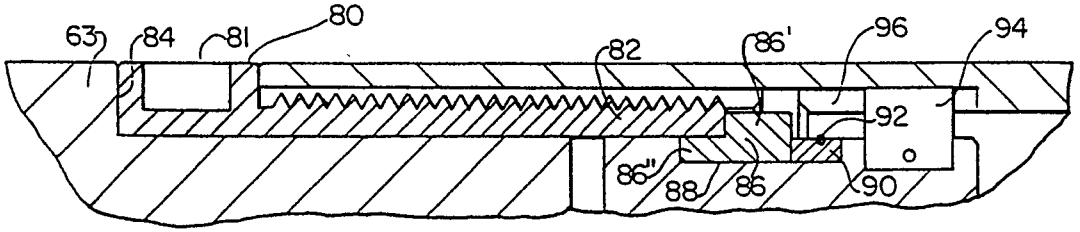
FIG. 1A is an enlarged cross sectional view of a portion of FIG. 1 showing the threaded collar joining the valve section upper sub to the valve section housing.

Referring to FIGS. 1 and 1A, threaded collar 64 has a larger diameter gripping portion 80 and a smaller diameter axially extending threaded portion 82. Threaded collar 64 is rotatably received over lower end 63 of the valve section upper sub 62 as shown in FIG. 1. Threaded collar 64 is axially constrained at its upper end by a shoulder 84 of valve section upper sub 62 adjacent threaded collar gripping portion 80. Threaded collar 64 is axially constrained at its lower end by a two-piece split ring 86 having a larger diameter portion 86' abutting against the lower end of threaded collar 64, and a smaller diameter portion 86" that is loosely fitted inside threaded portion 82 as shown in FIG. 1. When assembled, split ring 86 is concentrically received in an annular groove 88 at the lower end 63 of the valve section upper sub, and is trapped in annular groove 88 by a second split ring 90. Split ring 90 is held in place by a conventional C-spring 92 elastically retained in an annular groove around the outer periphery of split ring 90. This arrangement axially constrains threaded collar 64 while allowing it to freely rotate.

Sockets 81 extending radially inwardly from the outer periphery of gripping portion 80 allow for the rotation of threaded collar 64 by a standard spanner wrench. A radially extending key 94 is attached to lower end 63 of the valve section upper sub 62 adjacent threaded collar 64 and is matingly received in a key slot 96 that extends axially through the internal threads of the upper end of valve section housing 68. Threaded collar 64 is rotated with its threaded portion 82 engaging the internal threads at the upper end of valve section housing 68. Rotation of threaded collar 64 in a clockwise direction as viewed from the left of FIG. 1 causes the upper end of valve section housing 68 to be drawn over the lower end 63 of the valve section upper sub 62. Key 94 precludes relative rotation between valve section housing 68 and valve section upper sub 62 during the assembly operation and ensures proper relative alignment of mating components while permitting quick and efficient assembly.

Figure 9:
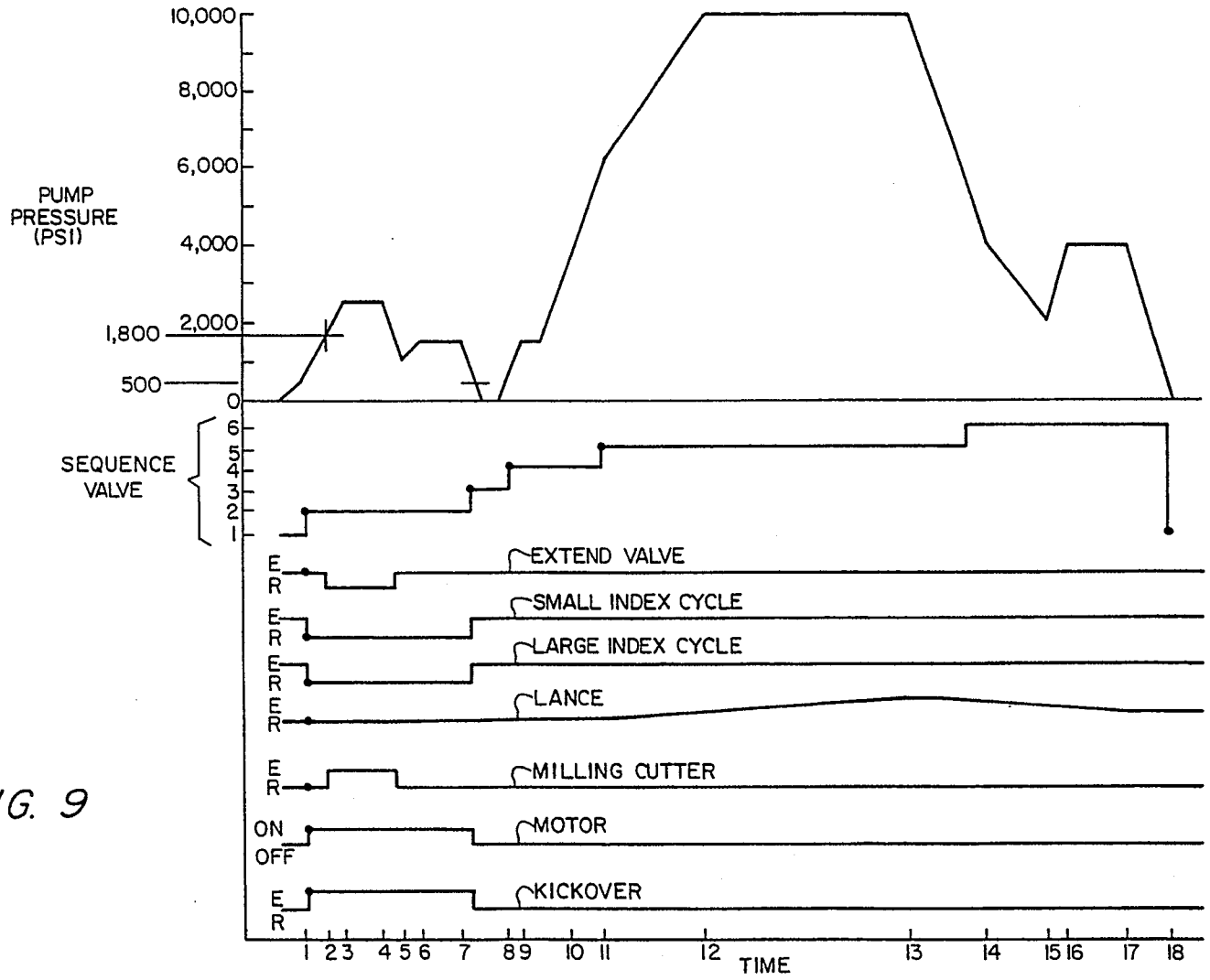
FIG. 9 is a timing chart showing the operation of the invention as a function of pressure and time.

Pressurized working fluid is provided to valve section upper sub 62 as described in U.S. Pat. No. 5,107,943 at column 18, lines 33–40. When down-hole apparatus 48 is in position at the bottom of well casing 42 the working fluid received at valve section upper sub 62 has a large hydrostatic pressure (head) as a result of the large volume of working fluid contained in pipe string 50 above valve section upper sub 62. The working fluid is pressurized to pressures above this hydrostatic pressure by a motorized pump 52 normally located in a service vehicle at the surface. A first axially extending bore 98 passes through valve section upper sub 62 and receives pressures in excess of hydrostatic pressure (where hydrostatic pressure is hereinafter assumed to equal 0 PSI as shown in FIG. 9) when the control section above the valve section upper sub 62 is in a retract mode as explained in U.S. Pat. No. 5,107,943.

A flexible, braided, steel-clad hose or lance L having a nozzle N on its lower end, and which is identical to the lance 206 of U.S. Pat. No. 4,640,362, extends downwardly from the lance housing into a plural component lance guide means 100 which extends from lance section 55 downwardly to the mill section housing 74 for permitting extension and retraction of the lance through the opening provided in the casing by operation of mill bit 268. The lance guide 100 from top to bottom comprises an axially parallel upper bore 100A and a canted bore 100B in valve section upper sub 62, an upper guide tube 100C extending the length of valve section housing 68, bores 100D and 100E in lower end wall plug 67 of valve section housing 68, bores 100F and 100G in intermediate sub 72, a lower guide tube 100H in mill section housing 74 and having its upper end 100H' slidably received in the lower end of bore 100G and a curved guide tube 100I attached at its lower extent to the carriage assembly 250 and attached at its upper end to the lower end of guide tube 100H.

When the control section 54 assumes an extend mode the working fluid in control pressure bore 98 returns to hydrostatic pressure (0 PSI) and the lance section begins to move the lance L downwardly so that nozzle N is moved outwardly through the opening in the casing while concurrently emitting high pressure jets for cutting through the surrounding formation. The control section 54 switches over from its retract mode, when working fluid is provided to control pressure bore 98, to its extend mode, when the working fluid reaches approximately 6000 PSI (6000 PSI above hydrostatic pressure).

As shown in FIG. 1, when the control section is in retract mode and pressure in excess of hydrostatic pressure is provided to bore 98, pressurized working fluid will exit valve section upper sub 62 into a sequence valve supply line 110 and a mill bit retract pressure and sequence valve pilot pressure line 112.

Figure 2:
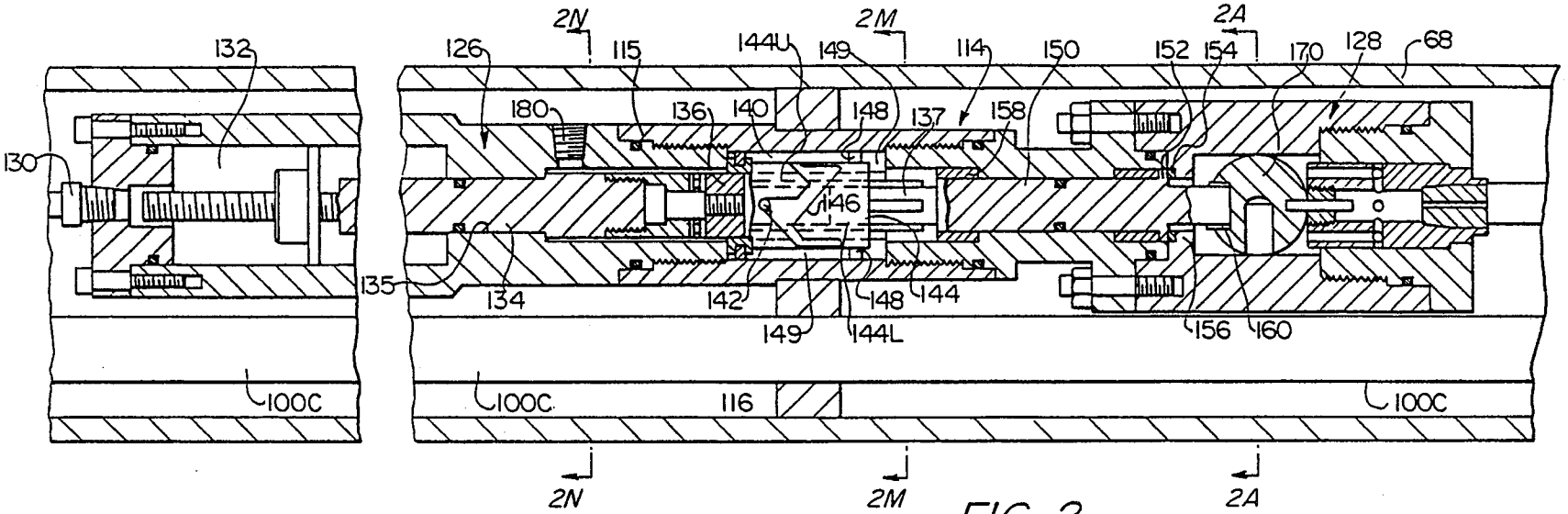
FIG. 2 is a longitudinal sectional view during the deactivated condition of the portion of the valve section housing containing the sequence valve.
Figure 2N:
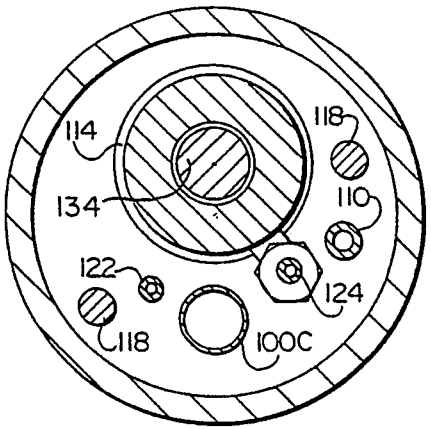
FIG. 2N is a cross sectional view taken along lines 2N—2N in FIG. 2.
Figure 2M:
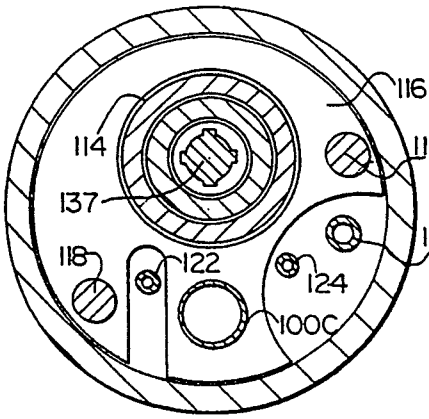
FIG. 2M is a cross sectional view taken along lines 2M—2M in FIG. 2.

A sequence valve 114 (FIG. 2) is located within valve section housing 68 directly below valve section upper sub 62. As shown in FIG. 2M, sequence valve 114 is radially located within valve section housing 68 by a disc-shaped wafer 116 which also has passages therethrough for chassis support rods 118, a lance tube 100C having an upper end communicating with the lower end of lance bore 100B, a mill bit retract pressure line 122, sequence valve supply line 110, and an accumulator pressure line 124.

Sequence valve 114 has an axially extending outer cylindrical housing 115 and consists essentially of an upper sequence valve piston section 126 and a lower ball section 128. Pressure is provided from a sequence valve pilot pressure line 130 to a chamber 132 on the top side of a piston 134 which is free to move axially and to rotate within an internal bore 135 of sequence valve piston section 126. The lower end of piston 134 extends into a second pressure chamber 140 and is connected to a female spline 136 which has a follower pin 142 protruding radially outwardly from the outer periphery of female spline 136 at right angles to the central axis of piston 134 as shown in FIG. 2.

A shaft 150 extends downwardly and in axial alignment with piston 134 and has male splines 137 which are matingly received in female spline 136. A two piece cam sleeve 144 includes an upper cam sleeve component 144U and a lower cam sleeve component 144L which concentrically surround the splined connection between piston 134 and shaft 150. Attention is invited to FIG. 2B which illustrates the operative components of nonrotatably positioned cam sleeve 144 and their relationship to a follower pin 142 extending radially outwardly from female spline 136. More specifically, cam sleeve 144 includes an upper cam sleeve component 144U and lower cam sleeve component 144L which are separated by a pin guide slot 145. The upper side of slot 145 is defined by a plurality of upper canted cam surfaces 146U which are connected at their upper ends to upper axially parallel surfaces 147U by upper curved transition surfaces 141U and relatively short slot wall surfaces 143U. Similarly, the lower side of guide slot 145 is defined by lower canted cam surfaces 146L, lower axially parallel surfaces 147L, lower curved transition surfaces 141L and lower relatively short slot wall surfaces 143L. The curved transition surfaces 141U and 141L alternately define dwell positions for follower pin 142. Keys 148 extend radially outwardly from cam sleeve 144 and are received within key slots 149 extending axially along the inner periphery of the portion of sequence valve piston section 126 surrounding pressure chamber 140. Cam sleeve 144 is thereby prevented from rotating relative to sequence valve 114 and cam surfaces 146 impart indexed rotary motion to piston 134 as axial reciprocation of piston 134 causes follower pin 142 to alternately move along upper canted cam surfaces 146U and lower cam surfaces 146L. As a result of the "J" configuration of cam surfaces 146U and 146L, rotary motion of piston 134 is always in the same direction regardless of the direction of axial movement of piston 134. The rotary motion of piston 134 would be in the clockwise direction as viewed in FIG. 2N and from the right of FIG. 2 during axial movement of piston 134.

The lower female splined end 136 of piston 134 slidably receives male splines 137 provided at the top end of shaft 150. Shaft 150 is constrained from axial movement as a result of a radially extending flange 152 which rides against a thrust bearing 154 supported on a radially inwardly extending shoulder 156 of sequence valve ball section 128. Shaft 150 is rotatably supported in sequence valve piston section 126 by two bearings 158. A lower male splined end 160 of shaft 150 engages with ball 170 and transmits rotational force from shaft 150 to ball 170, thereby moving ball 170 to each of the respective positions shown in FIGS. 2A, 2C, 2E, 2G, 2I, and 2K as piston 134 is reciprocated.

When ball 170 is in the position shown in FIG. 2C, an internal passageway 172 through ball 170 connects sequence valve supply port 174 to sequence valve outlet port 176. When ball 170 is in the position shown in FIG. 2C fluid flow is communicated from sequence valve supply line 110 to a motor run pressure and large index up cylinder pressure line 178.

An accumulator pressure port 180 (FIG. 2) in sequence valve piston section 126 provides a predetermined pressure to pressure chamber 140 that is greater than the standard hydrostatic pressure (0 PSI) seen by sequence valve 114 in pressure chamber 132, thereby forcing piston 134 to its normal uppermost position as shown in FIG. 2. The pressure provided through accumulator pressure port 180 is received from a nitrogen accumulator 224 (to be described below) and is predetermined as a function of the expected hydrostatic pressure at the operational depth of down-hole apparatus 48 and the dimensions of piston 134 so that piston 134 will remain in its normal uppermost position as shown in FIG. 2 until the pressure in chamber 132 is increased to approximately 500 PSI (or more accurately, 500 PSI greater than hydrostatic pressure). Therefore, each time pressure in chamber 132 provided by sequence valve pilot pressure line 130 is increased above 500 PSI, downward axial movement of piston 134 to its lowermost position causes pin 142 to move along cam surfaces 146 thereby rotating shaft 150 through its splined connection to piston 134 and advancing ball 170 to the next one of its six possible positions. Subsequently, when pressure in chamber 132 is reduced below 500 PSI, piston 134 again moves axially in an upward direction, thereby causing follower pin 142 to move along a cam surface on the upper portion of fixedly positioned cam sleeve 144 so that reaction of follower pin 142 against the cam surfaces of fixed cam sleeve 144 rotates (indexes) piston 134 sixty degrees with such indexed rotation being conveyed to shaft 150 through its splined connection with piston 134. The indexed rotation is again clockwise as viewed in FIG. 2A, thereby advancing ball 170 to its next sequential position. The dwell positions of pin 142 relative to cam surfaces 146U and 146L corresponding to each of the six positions of ball 170 are respectively shown in FIGS. 2B, 2D, 2F, 2H, 2J and 2L.

When ball 170 is in any of the positions other than the position shown in FIG. 2C, sequence valve outlet port 176 is out of communication with sequence valve supply port 174, and no pressure is provided to motor run pressure and large index up cylinder pressure line 178.

Figure 3:
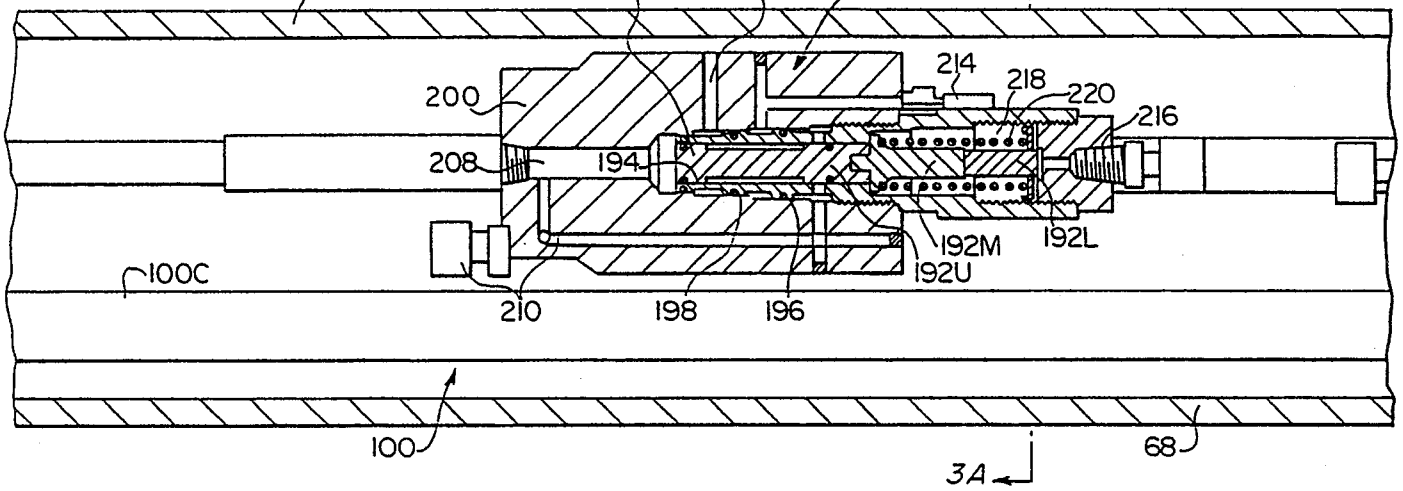
FIG. 3 is a longitudinal sectional view through a portion of the valve section housing containing the extend valve.
Figure 3A:
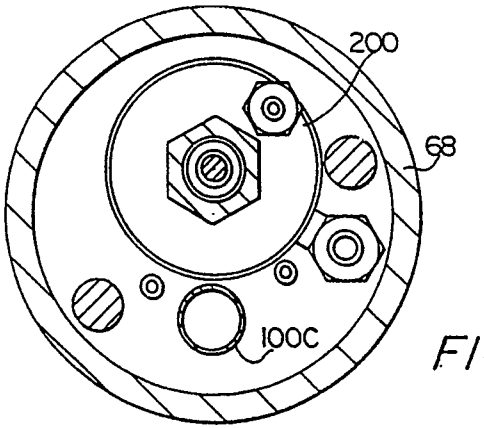
FIG. 3A is a sectional view taken along lines 3A—3A in FIG. 3.
Figure 3B:
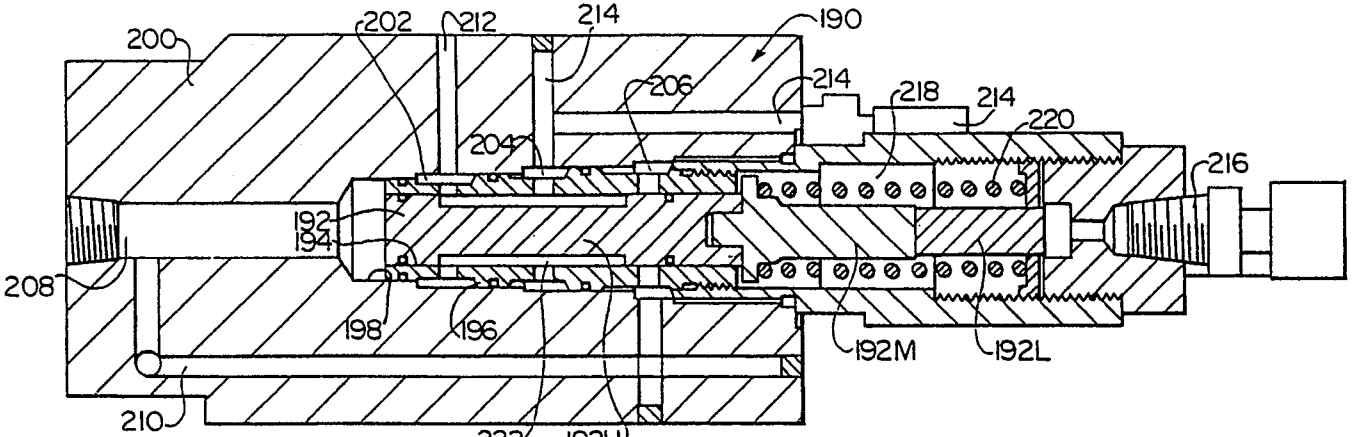
FIG. 3B is an enlarged longitudinal sectional view of the extend valve shown in FIG. 3 with the extend valve spool member in an upper position providing communication from the extend valve outlet line to an exhaust port.
Figure 3C:
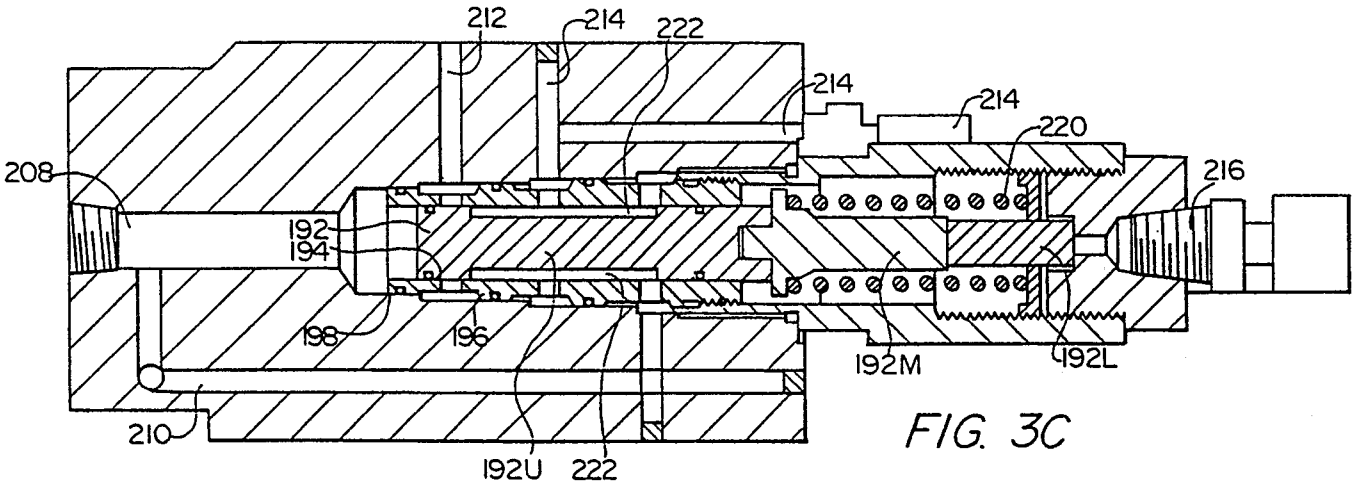
FIG. 3C is an enlarged longitudinal sectional view of the extend valve showing the extend valve spool member in a lower position providing communication between the extend valve inlet and outlet lines.
Figure 4:
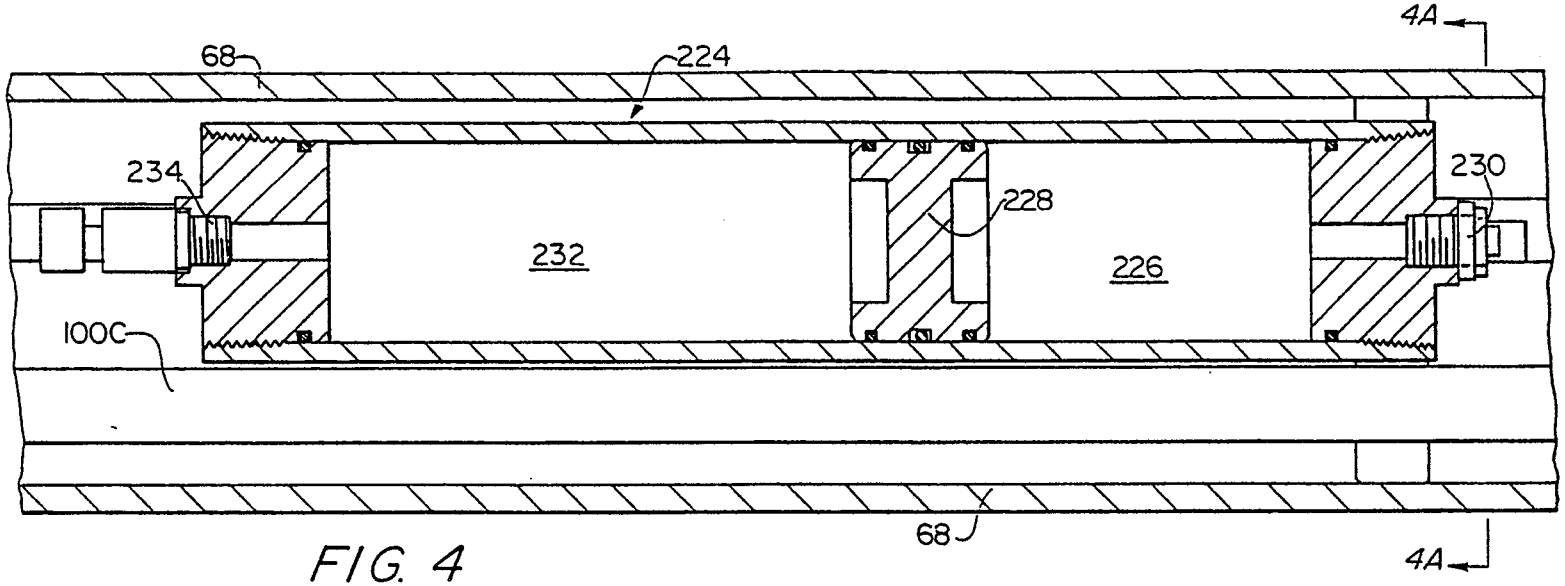
FIG. 4 is a longitudinal sectional view through a portion of the valve section housing containing the accumulator.
Figure 4A:
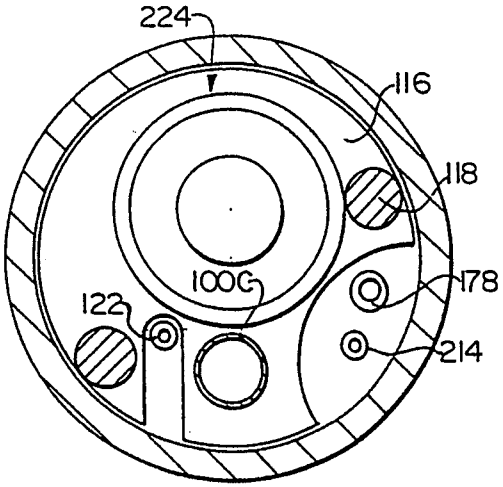
FIG. 4A is a sectional view taken along lines 4A—4A in FIG. 4.

As shown in FIGS. 3, 3B and 3C, an extend valve 190 is located below sequence valve 114 and consists essentially of a two position spool valve. When in a first position, extend valve 190 allows the communication of pressure to move a mill bit 268 (shown in FIG. 7) radially outwardly to engage the casing and when in a second position, extend valve 190 exhausts the mill bit moving means to permit radially inwardly retracting movement of the mill bit.

More specifically, a valve spool member 192 comprising an upper spool component 192U, a middle spool component 192M and a lower spool component 192L as best shown in FIG. 3B is mounted for axial movement in an axial bore 194 of a valve body sleeve 196 that is mounted coaxially in an axial bore 198 of extend valve housing cylinder 200. Extend valve sleeve 196 is provided with three axially spaced annular chamber grooves 202, 204 and 206 encircling the outer periphery of valve sleeve 196 as best shown in FIGS. 3B and 3C. Annular chamber groove 206 along with extend valve pressure chamber 208 on the top side of extend valve spool member 192 receives pressure from an extend valve pressure supply line 210 that is connected to motor run pressure and large index up cylinder pressure line 178. A transverse exhaust bore 212 communicates with annular chamber groove 202 and an extend valve pressure outlet line 214 communicates with annular chamber groove 204.

An accumulator inlet port 216 provides accumulator pressure to pressure chamber 218 on the bottom side of lower spool component 192L of extend valve spool member 192. This accumulator pressure along with a force from spring 220 biases extend valve spool member 192 to its upper position as shown in FIG. 3B, against pressure provided to pressure chamber 208. Spring 220 is selected so that the pressure needed in extend valve pressure chamber 208 to move extend valve spool member 192 to its lowermost position as shown in FIG. 3C is significantly greater than the pressure needed in sequence valve pressure chamber 132 to actuate sequence valve piston 134 and thereby rotate ball 170 to the position shown in FIG. 2A. Therefore, pressure in the motor run pressure and large index up cylinder pressure line 178 must continue to increase after ball 170 shifts to the position shown in FIG. 2A before sufficient pressure is provided to chamber 208 to actuate spool member 192 to its lowermost position as shown in FIG. 3C. The reason for the spacing of actuation pressures for the extend valve and the sequence valve will become clear after review of the operation section of the specification below.

When extend valve 190 is in its normal position as shown in FIG. 3B an annular chamber 222 on the outer periphery of extend valve spool member 192 connects extend valve pressure outlet line 214 to extend valve exhaust bore 212. When extend valve 190 is in its lower actuated position as shown in FIG. 3C, annular chamber groove 222 connects extend valve pressure supply line 210 with extend valve pressure outlet line 214.

A nitrogen accumulator 224 (FIG. 4) is located within valve section housing 68 at a position below extend valve 190. A lower nitrogen pressure chamber 226 on the bottom side of a piston 228 is charged with nitrogen gas through a fitting 230. On the top side of accumulator piston 228 a hydraulic fluid pressure chamber 232 is provided to communicate with an accumulator outlet port 234. The nitrogen in pressure chamber 226 is pressurized to a pressure necessary to counterbalance the tubing hydrostatic pressure that will exist in the extend valve pressure chamber 208 and in the sequence valve pressure chamber 132 when down-hole apparatus 48 is lowered to the bottom of well casing 42. Pressurized hydraulic fluid is provided from chamber 232 to accumulator inlet port 216 on extend valve 190 and to accumulator pressure port 180 on sequence valve 114.

Figure 5B:
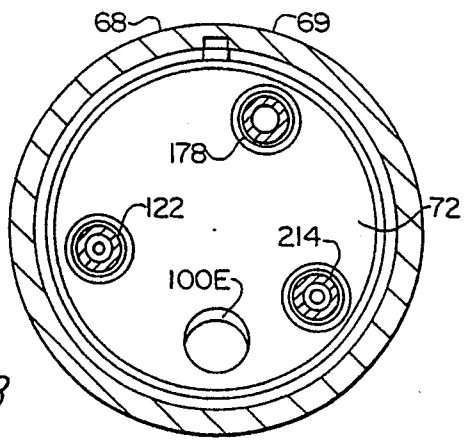
FIG. 5B is a cross sectional view taken along lines 5B—5B in FIG. 5.
Figure 5A:
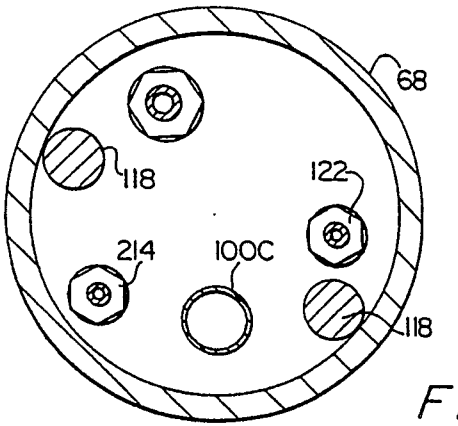
FIG. 5A is a cross sectional view taken along lines 5A—5A in FIG. 5.

At lower end 69 of valve section housing 68 an intermediate sub 72 (FIG. 5) is connected by a threaded collar 70 as described above for the connection between upper sub 62 and upper end 66 of valve section housing 68. Four axial bores pass through intermediate sub 72 and allow for the passage of lance L, extend valve pressure outlet line 214, mill bit retract pressure line 122 and motor run pressure and large index up cylinder pressure line 178 as best shown in FIGS. 5A and 5B.

Figure 6A:
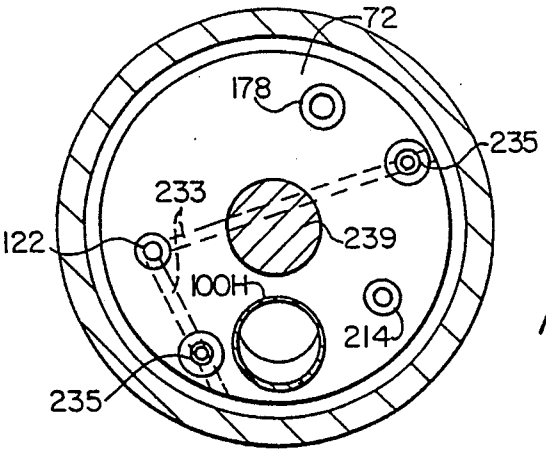
FIG. 6A is a sectional view taken along lines 6A—6A in FIG. 6.
Figure 6B:
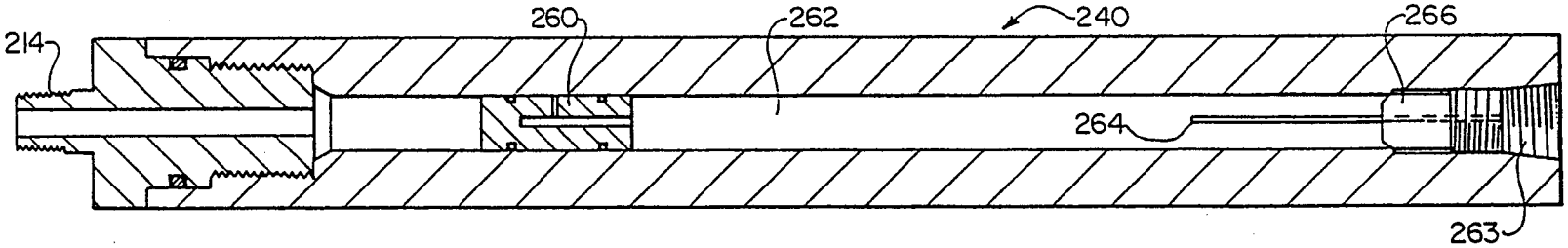
FIG. 6B is an enlarged longitudinal sectional view of the oil damper assembly.
Figure 6C:
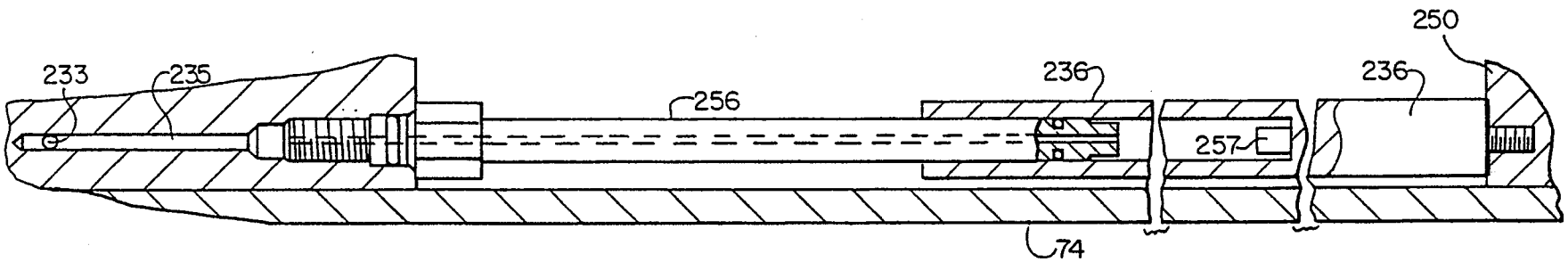
FIG. 6C is an enlarged longitudinal sectional view of the small index down cylinder.

As best shown in FIG. 6A, intermediate sub 72 is cross bored from the axial through bore for mill bit retract pressure line 122 to provide communicating passages 233 to two blind bores 235 extending in from the lower end of intermediate sub 72 and into which two small index down cylinders 236 are connected as shown in FIG. 6C. These cross bores in intermediate sub 72 ensure that when pressure is provided to mill bit retract pressure line 122, pressure will also be provided through the cross bores to small index down cylinders 236.

In addition to small index down cylinders 236, a large index up cylinder 238 (FIG. 6) and an oil damper assembly 240 shown in FIG. 6B extend from the lower end of intermediate sub 72 into the interior of mill section housing 74. The lower ends of small index down cylinders 236 and the lower end of the piston rod 258 extending downwardly from large index up cylinder 238 are connected to a carriage assembly 250 shown in FIG. 7 which is slidably mounted for axial up and down movement by bushings 252 on the inner surface of the lower end of mill section housing 74. The two small index down cylinders 236 are biased by any pressure greater than hydrostatic pressure, (which pressure exists whenever control section 54 is in the retract mode,) to move the carriage assembly 250 to its index down position. The same pressure supplied to small index down cylinders 236 is supplied through mill bit retract pressure line 122 to the retract side 284 of a mill bit piston 254 as shown in FIG. 7A.

The length of small index down cylinder pistons 256 and the length of the bore of small index down cylinders 236 establish the approximately three inches of travel of carriage assembly 250 in the upward direction. A spacer 257 can be placed at the bottom of small index down cylinder 236 as shown in FIG. 6C to provide an accurate means for controlling this travel.

Large index up cylinder 238 and its associated piston rod 258 are connected to carriage assembly 250 in order to pull carriage assembly 250 up whenever pressure is supplied through motor run pressure and large index up cylinder pressure line 178. As explained above in reference to the sequence valve 114, the pressure supplied to pressure chamber 132 of sequence valve 114 must be increased to approximately 500 PSI before sequence valve 114 is actuated to the position shown in FIG. 2C, thereby enabling communication of pressure to motor run pressure and large index up pressure line 178. A pressure line connects line 178 to port 259 on large index up cylinder 238. The downward travel of carriage assembly 250 is controlled by the travel of large index up cylinder piston 258' until it contacts the bottom end of large index up cylinder 238. The effective cross sectional area of large index up cylinder piston 258' is greater than the sum of the effective cross sectional areas of small index down cylinder pistons 256. Therefore, larger piston 258' overpowers the smaller pistons 256 and indexes carriage assembly 250 to the uppermost position whenever pressure is supplied through motor run pressure and large index up cylinder pressure line 178 to large index up cylinder 238.

Oil damper 240, shown in FIG. 6B, receives pressure from extend valve pressure outlet line 214 whenever extend valve 190 is moved to its open position as shown in FIG. 3C. The extend pressure is applied to the upper side of oil damper piston 260, which in turn applies the same pressure to silicon oil contained within a chamber 262 below oil damper piston 260. A needle type oil damper orifice 264 is mounted in a plug 266 in the bottom of chamber 262 and restricts the flow of the silicon oil as it exits chamber 262 and is supplied through conduit to the extend side 282 (FIG. 7A) of mill bit piston 254. The size of oil damper orifice 264 and the viscosity of the silicon oil in chamber 262 therefore control the rate at which mill bit 268 connected to mill bit piston 254 is moved radially outwardly (extended) into contact with well casing 42 during a milling operation. Orifice 264 comprises a needle having a small inner diameter and a relatively long length, with the needle being welded into a mating hole through plug 266, as shown in FIG. 6B. However, other conventional orifices could be employed for the same purpose if desired.

Kickover assembly 76 is connected to the lower end of mill section housing 74 below carriage assembly 250 as shown in FIG. 8. Whenever pressure is applied to cutter drive hydraulic motor 270 from motor run pressure and large index up cylinder pressure line 178, the same pressure is applied from line 178 to kickover assembly 76 through pressure line 178' to kickover assembly port 272 as shown in FIG. 8. This pressure urges kickover assembly piston 274 radially outwardly, compressing spring 276 and forcing foot 278 against the inner surface of well casing 42 with considerable force. As a result, mill section housing 74 is shifted laterally and decentralized relative to well casing 42, thereby reducing the radial gap between mill section housing 74 and well casing 42 and bringing mill bit 268 into proximity with the inner surface of well casing 42 in preparation for the milling operation. This feature enables the down-hole apparatus 48 to be used in a variety of well casings having different inner diameters without requiring any modification to the down-hole apparatus. Kickover assembly 76 is retracted whenever the pressure supplied to hydraulic motor 270 via line 178 is shut off. Kickover assembly spring 276 retracts kickover assembly piston 274 and foot 278 causing the fluid behind piston 274 to exhaust out port 272 and back through hydraulic motor 270 to a motor exhaust outlet port.

Figure 7:
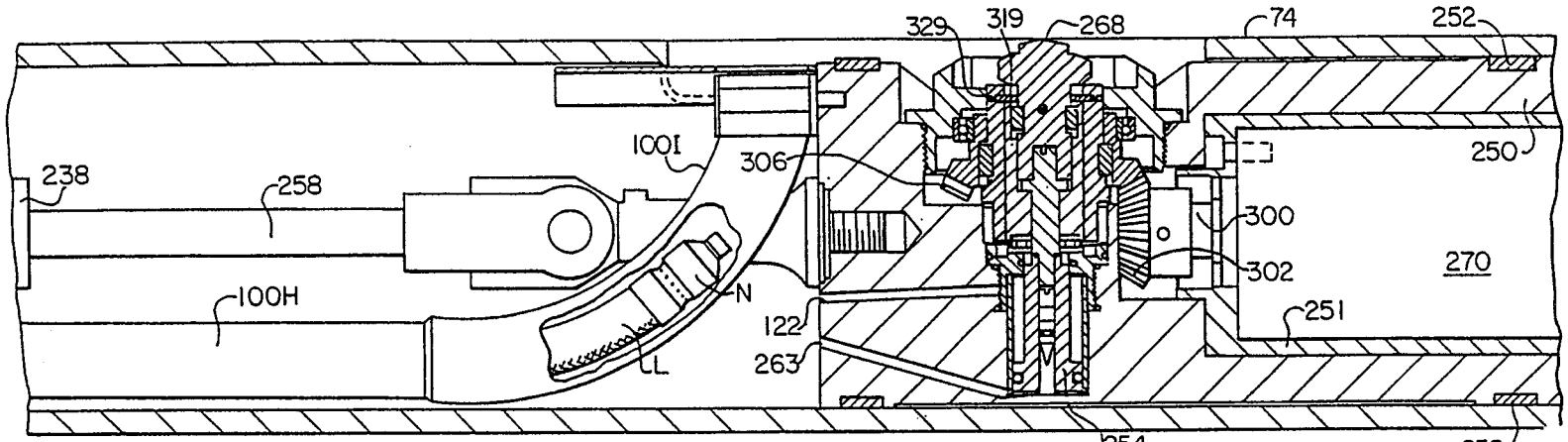
FIG. 7 is a longitudinal sectional view taken through the mill section housing showing the carriage assembly with lance guide attached.
Figure 7B:
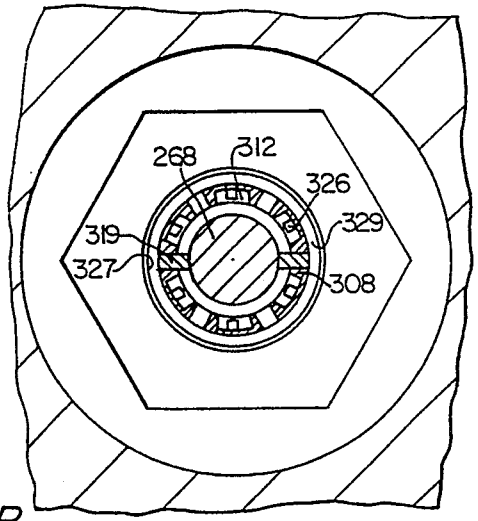
FIG. 7B is a sectional view taken along lines 7B—7B in FIG. 7A.
Figure 7A:
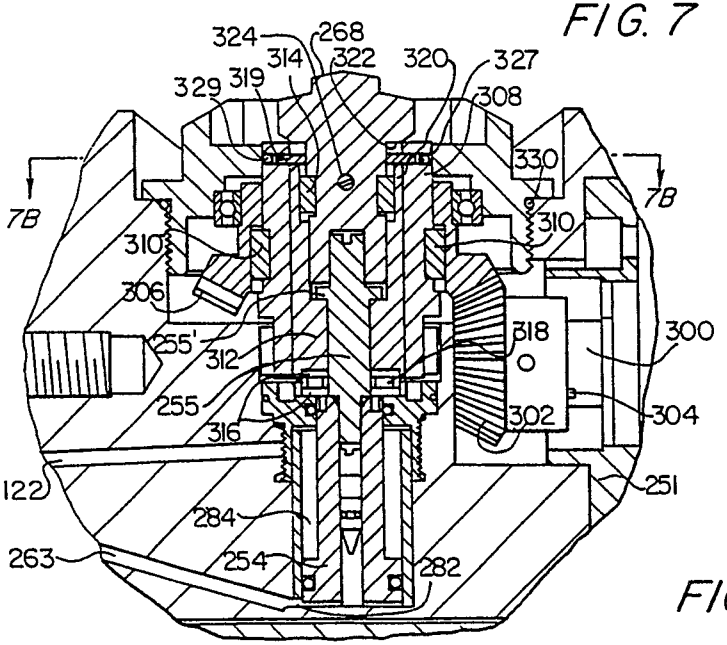
FIG. 7A is an enlarged sectional view showing the details of the mill bit, mill bit piston and spline assembly.
Figure 7C:
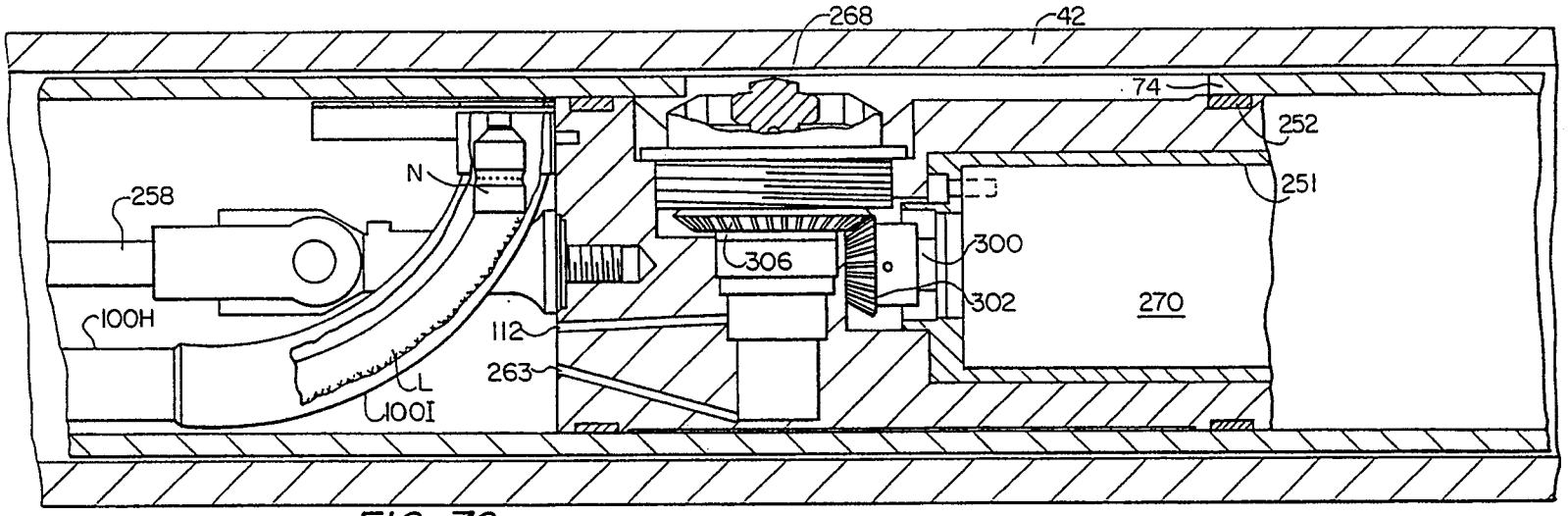
FIG. 7C is a longitudinal sectional view taken through the mill section housing showing the carriage assembly in an index up position prior to extending the rotating mill bit to drill a hole through the well casing.

Referring to FIGS. 7 and 7A, mill bit 268 is rotated in carriage assembly 250 when hydraulic motor 270 receives fluid flow from motor run pressure and large index up cylinder pressure line 178. Hydraulic motor 270 is supported in carriage assembly 250 by motor bracket 251. Hydraulic motor shaft 300 rotates pinion gear 302 via a key 304. Pinion gear 302 rotates a ring gear 306 which rotates female spline 308 via keys 310. Female spline 308 rotates male spline 312 due to the engagement of their splines, and male spline 312 rotates mill bit 268 via keys 314.

Mill bit piston 254 is acted on by silicon oil supplied to its mill bit extend chamber 282 from silicon oil chamber 262 of oil damper assembly 240. Mill bit piston 254 is also acted on by pressure to its mill bit retract chamber 284 at all times that the main control section is in its retract mode and supplying pressure to mill bit retract pressure and sequence valve pilot pressure line 112 and therefore mill bit retract line 122.

The cross sectional area of the extend side of mill bit piston 254 is greater than the cross sectional area of the retract side, and therefore mill bit piston 254 will extend whenever extend valve 190 is opened to the position shown in FIG. 3C and silicon oil is forced through oil damper orifice 264, providing a controlled feed rate of the rotating mill bit 268. As mill bit piston 254 extends, a force is transmitted through thrust washers 316 and thrust bearing 318 to male spline 312.

Two shear pins 319 shown in FIG. 7A are installed into an O-ring seal groove 327 in female spline 308 before lowering down hole apparatus 48 into well casing 42. Shear pins 319 extend radially inwardly over the end 320 of male spline 312 and retain male spline 312 in its retracted position until the force generated by mill bit piston 254 causes male spline 312 to shear shear pins 319. Shear pins 319 thereby insure that mill bit 268 will not be extended accidentally before extend valve 190 is opened to the position shown in FIG. 3C and silicon oil is provided to mill bit extend chamber 282.

After shear pins 319 have been sheared off, mill bit 268 is extended radially outwardly by male spline 312 as a result of contact between the outer end 320 of male spline 312 with the inner edge 322 of mill bit 268. Set screws 324 hold mill bit 268 to male spline 312 as shown in FIG. 7A. Mill bit 268 is retracted radially inwardly by male spline 312 through set screws 324 and a shoulder 255' on a mill bit piston shaft 255 that extends in axial alignment with mill bit piston 254.

Notches 326 are cut axially along the outer periphery of male splines 312 as shown in FIG. 7B. These notches provide a passage for hydraulic fluid that is exhausted from hydraulic motor 270 and direct this fluid against the back side of mill bit 268 and along the cutting surfaces, thereby cooling the cutter and flushing away chips that are produced during the milling operation. The exhaust fluid from motor 270 enters motor exhaust chamber 271 below carriage assembly 250 and flows out bull plug drain holes 331 as well as back up around motor 270 through gaps between motor bracket 251 and motor 270. The fluid that flows back up around motor 270 is directed to notches 326 as a result of O-ring seals 329 and 330 which block any alternative exit passageways for the fluid.

OPERATION

A description of the operation of the milling apparatus follows with it being understood that the sequence valve components are positioned as shown in FIG. 2.

Attention is also directed to FIG. 9 which shows the operative positions of the major control components of downhole apparatus 48 as a function of pump pressure and time. A pump pressure of 0 PSI as shown on the graph of FIG. 9 corresponds to the hydrostatic pressure existing at the control components of down-hole apparatus 48 as a result of the hydraulic working fluid present in the pipe string extending from the down-hole apparatus up to the surface. At pump pressures from 0 PSI to approximately 6000 PSI main control section 54 above valve section upper sub 62 is in a retract mode as described in U.S. Pat. No. 5,107,943. During this range of pressures, pressurized hydraulic working fluid is provided through control pressure bore 98 in valve section upper sub 62 to both sequence valve supply line 110 and mill bit retract pressure and sequence valve pilot pressure line 112 as shown in FIG. 1.

Figure 2A:
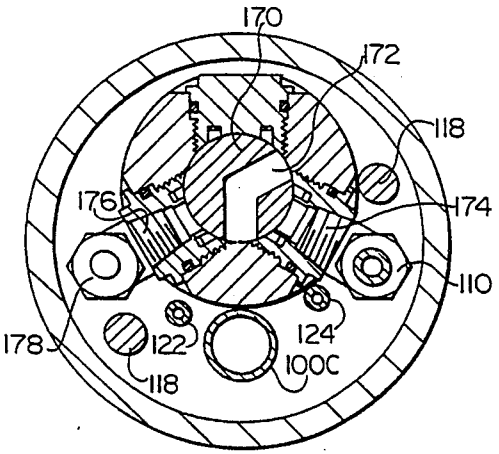
FIG. 2A is a cross sectional view taken along lines 2A—2A in FIG. 2 showing the sequence valve ball in a first position.
Figure 2B:
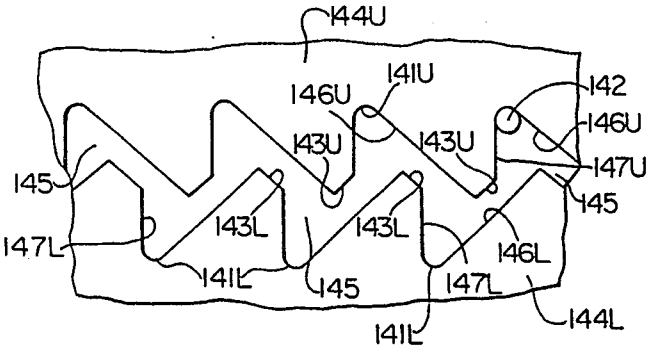
FIG. 2B is an enlarged profile of cam sleeve means and a valve pin engaged therewith for positioning the sequence valve ball in the position shown in FIG. 2A.

At the beginning of the operation, ball 170 is in the position 1 illustrated in FIG. 2A and sequence valve pin 142 engages the upper end of upper canted cam surface 146U.

At time $T_1$, when pump pressure reaches approximately 500 PSI, ball 170 in sequence valve 114 is shifted to the position shown in FIG. 2C wherein pressure is communicated from sequence valve supply port 174 to sequence valve outlet port 176 and thereafter to motor run pressure and large index up cylinder pressure line 178 from which it flows into hydraulic motor 270 which begins to rotate, driving mill bit 268; kickover foot 278 is extended against well casing 42; and pressure is provided to large index up cylinder 238 causing it to retract and to overpower small index down cylinders 236, thereby indexing carriage assembly 250 to its upper position. When carriage assembly 250 is moved to its upper position, the upper end 100H' of tube 100H moves upwardly in bore 100G of intermediate sub 72 (FIG. 6). Mill section housing 74 and mill bit 268 are decentralized (shifted radially) relative to the well casing as a result of the extension of kickover foot 278. Between time $T_1$ and $T_2$ pressure is provided to extend valve pressure supply line 210 from a tee connection to motor run pressure and large index up cylinder pressure line 178.

At time $T_2$, pump pressure has increased to approximately 1800 PSI. Extend valve pressure chamber 208 receives this pressure from extend valve pressure supply line 210 which is connected to motor run pressure and large index up cylinder pressure line 178. At approximately 1800 PSI the pressure is sufficient to overcome a force generated by the combination of accumulator pressure provided through port 216 to extend valve pressure chamber 218 on the lower side of extend valve spool member 192 and the force generated by extend valve spring 220. Extend valve spool member 192 is consequently moved to its lower position as shown in FIG. 3C at which position the pressure is communicated from extend valve pressure supply line to extend valve pressure outlet line 214 and from there to the top side of oil damper piston 260 in oil damper assembly 240. This pressure causes silicon oil to be ejected from silicon oil chamber 262 in oil damper assembly 240 through an orifice and through a line to a mill bit extend chamber 282 and results in the gradual extension of mill bit 268 into contact with well casing 42. The requirement of a higher pressure to extend mill bit 268 than the pressure necessary to activate index up cylinder 238 ensures that carriage assembly 250 and mill bit 268 will be in their uppermost position before the mill bit is extended.

At time $T_3$, pump pressure is subsequently increased to approximately 2500 PSI and is held there for two to three minutes until time $T_4$ while mill bit 268 is rotated by hydraulic motor 270 and extended by the pressure supplied to extend chamber 282. During this time period, mill bit 268 cuts through well casing 42.

From time $T_4$ to time $T_5$, pump pressure is gradually decreased until at approximately 1800 PSI extend valve 190 returns to its closed position as shown in FIG. 3B, thereby discontinuing the supply of pressure to mill bit extend chamber 282 and allowing the pressure to exhaust from mill bit extend chamber 282 through exhaust bore 212 in extend valve 190 as pressure continues to be supplied to retract chamber 284. The pressure that is supplied continuously to mill bit retract chamber 284 whenever the main control section 54 is in the retract mode causes the retraction of mill bit 268 once pressure has been exhausted from mill bit extend chamber 282.

From time $T_5$ to time $T_7$, pump pressure is increased back up to approximately 1500 PSI in order to provide the maximum possible pressure to mill bit retract chamber 284 without exceeding the threshold pressure of approximately 1800 PSI at which extend valve 190 would return to its open position as shown in FIG. 3C.

After time $T_7$, pump pressure is reduced gradually to 0 PSI. After pump pressure drops below approximately 500 PSI the pressure provided to sequence valve pressure chamber 132 is no longer sufficient to overcome the accumulator pressure provided through accumulator pressure port 180 to the pressure chamber 140 on the bottom side of sequence valve piston 134. Sequence valve piston 134 is consequently moved axially to its uppermost position and the movement of pin 142 along cam surfaces 146 causes shaft 150, which is splined to piston 134, to rotate ball 170 to the position shown in FIG. 2E, thereby cutting off communication between sequence valve supply port 174 and sequence valve outlet port 176. Pressure supply in excess of hydrostatic pressure is now cut off to motor run pressure and large index up cylinder pressure line 178. Therefore, small index down cylinders 236, which continue to receive pressure from the mill bit retract pressure line 122 through communicating passages 233 in intermediate sub 72, overpower large index up cylinder and cause carriage assembly 250 to index down to its lowermost position. Curved guide tube 100I is positioned adjacent the hole drilled by mill bit 268 since it is connected to carriage assembly 250 at a position spaced above mill bit 268 by a distance equal to the travel of carriage assembly 250.

Pump pressure is then increased again from 0 PSI until at time $T_8$ the pressure has reached approximately 500 PSI. At this pressure, sequence valve piston 134 is again shifted axially downwardly, thereby rotating ball 170 to its next position as shown in FIG. 2G. In this position there is still no communication between sequence valve supply port 174 and sequence valve outlet port 176. Therefore, no pressure is provided to run hydraulic motor 270 or to index carriage assembly 250 to its index up position. The location of sequence valve ball 170 at this position can be verified at the surface pump 52 by maintaining a pressure of approximately 1500 PSI after time $T_9$ for a short period of time and checking for zero flow rate to insure that hydraulic motor 270 is not operating.

After the preceding flow check, which verifies that the motor is off and the mill bit is retracted and in its index down position, pump pressure is increased until at a pressure of approximately 6000 PSI the main control section switches over from its retract mode to an extend mode as described in U.S. Pat. No. 5,107,943. At this time, pressure is no longer supplied to sequence valve pilot pressure line 130 and sequence valve pressure chamber 132. Sequence valve piston 134 consequently returns to its uppermost position and ball 170 is shifted to the position shown in FIG. 2I. At this position there is still no communication between sequence valve supply port 174 and sequence valve outlet port 176.

After time $T_{11}$, at pressures in excess of 6000 PSI, a lance L begins extending from curved guide tube 100I through the hole drilled through well casing 42 by mill bit 268 and high pressure fluid is pumped from a nozzle N at the end of lance L to cut a passageway into the surrounding formation as lance L is extended.

From time $T_{12}$ to time $T_{13}$, with a pump pressure of approximately 10,000 PSI, lance L continues to extend, cutting a passageway into surrounding formation.

Figure 7D:
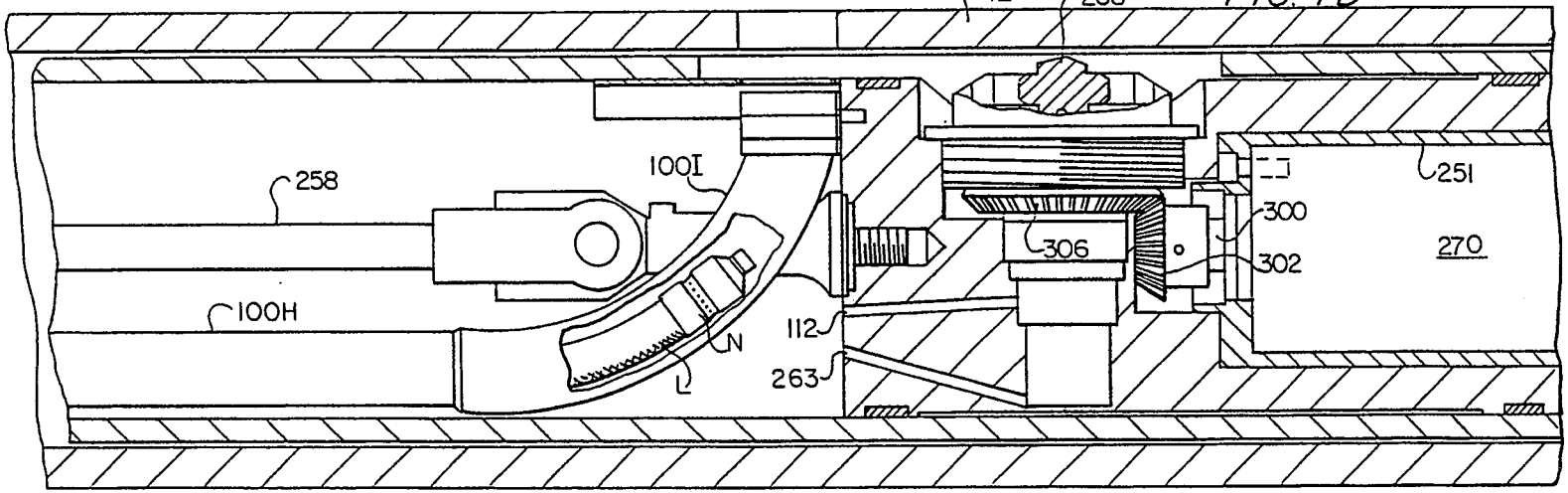
FIG. 7D is a longitudinal sectional view taken through the mill section housing showing the carriage assembly in an index down position after completing a hole through the well casing.

After time $T_{13}$, pump pressure is gradually reduced until at a pump pressure of approximately 6000 PSI the main control section resets to its retract mode and lance L begins to retract into curved guide tube 100I. When the main control section switches back to its retract mode, pump pressure is again supplied to sequence valve supply line 110 and mill bit retract pressure and sequence valve pilot pressure line 112. This pressure causes sequence valve piston 134 to shift axially to its lower position, thereby moving ball 170 to the position shown in FIG. 2K. In this position, as in the previous three positions of ball 170, pressure is not communicated from sequence valve supply port 174 to sequence valve outlet port 176. Therefore, hydraulic motor 270 remains in the off position, mill bit 268 remains in its retracted position, large carriage index up cylinder 238 remains in its extended position and small carriage index down cylinders 236 remain in their extended positions with carriage assembly 250 in its index down position and curved guide tube 100I adjacent the hole drilled through well casing 42 as shown in FIG. 7D.

Pump pressure is reduced until time $T_{15}$ and a pressure of approximately 2000 PSI in order to ensure that the main control section has been reset to its retract mode. From time $T_{15}$ to time $T_{17}$ pump pressure is again increased to approximately 4000 PSI and maintained there in order to provide a maximum possible lance retract force.

After time $T_{17}$ the pump pressure is gradually reduced until at approximately 500 PSI sequence valve piston 134 again shifts axially to its uppermost position, thereby moving ball 170 to the position shown in FIG. 2A. After this time the entire down-hole apparatus 48 can be moved to a new position relative to well casing 42 and the entire sequence of events as shown in FIG. 9 can be repeated in order to drill through the well casing at another location and out into the surrounding formation.

Modifications and variations of the above-described embodiments of the present invention are possible, as appreciated by those skilled in the art in light of the above teachings.

It is therefore to be understood that, within the scope of the appended claims and their equivalents, the invention may be practiced otherwise than as specifically described.

LIST OF DESIGNATORS

40-oil well
42-well casing
44-oil bearing strata
46-contaminated zone
48-downhole apparatus
50-pipe string
51-stabilizer/anchor
52-pump
53-filter
54-control section
55-lance section
60-valve section upper sub top end
62-valve section upper sub
63-valve section upper sub lower end
64-threaded collar
66-upper end valve section housing
67-lower end wall plug
68-valve section housing
69-lower end valve section housing
70-threaded collar
71-threaded collar
72-intermediate sub
74-mill section housing
76-kickover assembly
80-threaded collar gripping portion
81-socket
82-threaded collar threaded portion
84-shoulder
86-split ring
86'-larger diameter portion of split ring 86
86"-smaller diameter portion of split ring 86
88-annular groove
90-split ring
92-C-spring
94-key
96-key slot
98-control pressure bore
100-lance bore
100A-bore
100B-canted bore
100C-upper guide tube
100D-bore
100E-bore
100F-bore
100G-bore
100H-lower guide tube
100I-curved guide tube
110-sequence valve supply line
112-mill bit retract pressure and sequence valve pilot pressure line
114-sequence valve
115-cylindrical housing
116-wafer
118-chassis support rods
122-mill bit retract pressure line
124-accumulator pressure line
126-sequence valve piston section
128-sequence valve piston ball section
130-sequence valve pilot pressure line
132-sequence valve chamber
134-piston
135-piston bore
136-female spline
137-male spline
140-pressure chamber
141-curved transition surfaces 141U-upper curved transition surface
141L-lower curved transition surface
142-follower pin
143U-upper short slot wall surface
143L-lower short slot wall surface
144-cam sleeve
144U-upper cam sleeve component
144L-lower cam sleeve component
145-pin guide slot
146-cam surfaces
146U-upper cam surfaces
146L-lower cam surfaces
147U-upper axially parallel surfaces
147L-lower axially parallel surfaces
148-key
149-key slots
150-shaft
152-flange
154-thrust bearing
156-shoulder
158-bearings
160-male splined end of shaft 150
170-ball
172-internal passageway
174-sequence valve supply port
176-sequence valve outlet port
178-motor run pressure and large index up cylinder pressure line
178'-motor run pressure and large index up cylinder pressure line to kickover assembly
180-accumulator pressure port
190-extend valve
192-extend valve spool member
192U-upper spool component
192M-middle spool component
192L-lower spool component
194-extend valve sleeve bore
196-extend valve sleeve
198-extend valve housing bore
200-extend valve housing cylinder
202-annular chamber groove
204-annular chamber groove
206-annular chamber groove
208-extend valve pressure chamber
210-extend valve pressure supply line
212-exhaust bore
214-extend valve pressure outlet line
216-accumulator inlet port
218-extend valve pressure chamber
220-spring
222-annular chamber groove
224-Nitrogen accumulator
226-Nitrogen pressure chamber
228-accumulator piston
230-fitting
232-hydraulic fluid pressure chamber
233-communicating passages
234-accumulator outlet port
235-intermediate sub blind bore
236-small carriage index down cylinder
238-large carriage index up cylinder
239-large carriage index up cylinder upper anchor
240-oil damper assembly
250-carriage assembly
251-motor bracket
252-carriage assembly bushing
254-mill bit piston
255-mill bit piston shaft
255'-mill bit piston shaft shoulder
256-small carriage index down cylinder pistons
257-small carriage index down cylinder spacer
258-large carriage index up cylinder piston rod
258'-large carriage index up cylinder piston
259-large carriage index up cylinder pressure supply port
260-oil damper piston
262-silicon oil chamber
263-mill bit extend line
264-oil damper orifice
266-plug
268-mill bit
270-cutter drive hydraulic motor
271-motor exhaust chamber
272-kickover assembly port
274-kickover assembly piston
276-kickover assembly spring
278-kickover assembly foot
282-mill bit extend chamber
284-mill bit retract chamber
300-motor shaft
302-pinion gear
304-key
306-ring gear
308-female spline
310-key
312-male spline
314-key
316-thrust washers
318-thrust bearing
319-shear pin
320-male spline outer end
322-inner edge of mill bit
324-set screws
326-notch
327-O-ring seal groove
328-bull plug
329-O-ring seal
330-O-ring seal
331-bull plug drain holes
L-lance, N-nozzle

What is claimed is:

1. A well penetrator for use in a well having a well casing, said penetrator comprising:

a valve section housing, a mill section housing connected to said valve section housing, and a kickover assembly connected to said mill section housing;

a sequence valve supported in said valve section housing and having control means for actuating said sequence valve to a first open position allowing flow of pressurized hydraulic working fluid therethrough and into a first pressure line, and a second, closed position preventing flow of pressurized hydraulic working fluid therethrough;

an extend valve supported in said valve section housing and having first and second operative positions wherein pressurized hydraulic working fluid from said first pressure line passes through said extend valve in said second position into an extend pressure line, and wherein pressurized hydraulic working fluid is exhausted from said extend pressure line through said extend valve in said first position;

an accumulator having a predetermined set pressure for providing a control pressure to said sequence valve and said extend valve;

a hydraulic motor supported in said mill section housing and being powered by said pressurized hydraulic working fluid when said sequence valve assumes said first open position;

a mill bit supported in said mill section housing for axial movement and rotation and being rotated through angle drive means by said hydraulic motor for cutting a hole through said well casing;

said kickover assembly having means for decentralizing said mill section housing relative to said well casing, thereby moving said mill bit into proximity with said well casing;

and a lance assembly supported in said valve section housing and said mill section housing and having a high pressure nozzle for movement through and beyond said hole in the casing and for directing high pressure hydraulic working fluid into the surrounding formation.

2. The well penetrator of claim 1 wherein said sequence valve comprises a piston, a ball having a bore therethrough, and said control means includes means for converting axial movement of said piston into rotary movement of said ball;

said extend valve comprises a two position spool valve;

and said mill bit being driven in an axial direction by a mill bit piston having a piston extend chamber on one side of said piston for receiving pressure from said extend pressure line and a piston retract chamber on a side of said piston opposite from said one side.

3. The well penetrator of claim 2 wherein said extend pressure line is connected to an oil damper assembly for controlling a rate of increase of said pressure received by said piston extend chamber.

4. The well penetrator of claim 3 wherein said oil damper assembly includes an orifice for controlling the pressure supplied to said piston extend chamber.

5. The well penetrator of claim 1 wherein said angle drive means includes a splined connection for permitting axial and rotary movement of said mill bit, and wherein a plurality of splines in said splined connection have notches along an axial length of their outer peripheries with said notches providing a path for a coolant and directing said coolant against said mill bit.

6. The well penetrator of claim 5 wherein said coolant consists essentially of hydraulic working fluid exhausted from said hydraulic motor.

7. The well penetrator of claim 5 wherein said sequence valve comprises a piston, a ball having a bore therethrough, and said control means includes means for converting axial movement of said piston into rotary movement of said ball;

said extend valve comprises a two position spool valve;

and said mill bit is driven in an axial direction by a mill bit piston having a piston extend chamber on one side of said piston for receiving pressure from said extend pressure line and a piston retract chamber on a side of said piston opposite from said one side.

8. The well penetrator of claim 7 wherein said extend pressure line is connected to an oil damper assembly for controlling a rate of increase of said pressure received by said piston extend chamber.

9. The well penetrator of claim 8 wherein said oil damper assembly includes an orifice for controlling the pressure supplied to said piston extend chamber.

10. The well penetrator of claim 1 wherein said sequence valve has six operative positions of which only said first open position allows flow of pressurized hydraulic working fluid therethrough and into said first pressure line.

11. The well penetrator of claim 10 wherein said extend valve comprises a two position spool valve; and said mill bit being driven in an axial direction by a mill bit piston having a piston extend chamber on one side of said piston for receiving pressure from said extend pressure line and a piston retract chamber on a side of said piston opposite from said one side.

12. The well penetrator of claim 11 wherein said extend pressure line is connected to an oil damper assembly for controlling a rate of increase of said pressure received by said piston extend chamber.

13. The well penetrator of claim 1 further including a carriage assembly slidably supported in said mill section housing and having mounted thereon said hydraulic motor, said mill bit and one end of said lance assembly;

a small index down cylinder connected to said carriage assembly and said mill section housing for moving said carriage assembly in a downward direction relative to said mill section housing whenever said sequence valve is not in said first open position; and a large index up cylinder connected to said carriage assembly and said mill section housing for moving said carriage assembly in an upward direction relative to said mill section housing whenever said sequence valve is in said first open position.

14. The well penetrator of claim 13 wherein a plurality of teflon slide rings are positioned around the outer periphery of said carriage assembly and are slidably supported in said mill section housing.

15. A method of operating a well penetrator for drilling a hole through a well casing wherein said well penetrator includes a sequence valve having a plurality of operating positions, a two position extend valve, an oil damper assembly, a large carriage index up hydraulic cylinder, small carriage index down hydraulic cylinder means, a carriage assembly connected to said hydraulic cylinders, a lance guide supported at one end on said carriage assembly, a high pressure lance slidably mounted within said lance guide, a hydraulic motor supported on said carriage assembly, a mill bit rotatably driven by said hydraulic motor and being axially movable by a piston having an extend chamber on one side of said piston and a retract chamber on a side of said piston opposite from said one side, and a kickover assembly having means for moving said mill bit into proximity with said well casing; the method including the steps of:

1) pumping pressurized hydraulic working fluid to said retract chamber and to said small carriage index down hydraulic cylinder means;

2) increasing the pressure of the working fluid to a first predetermined pressure to actuate said sequence valve to an operating position wherein pressurized hydraulic working fluid passes through said sequence valve to said hydraulic motor, said large carriage index up hydraulic cylinder and said kickover assembly;

3) further increasing the pressure of the working fluid passing through the sequence valve to a second predetermined pressure higher than the first predetermined pressure to actuate said extend valve to an open position wherein pressurized hydraulic working fluid passes through said extend valve to said oil damper assembly causing a controlled increase in pressure supplied to said extend chamber;

4) reducing the pressure of the working fluid passing through the sequence valve to the first predetermined pressure to allow the extend valve to return to its closed position wherein pressure is exhausted from said oil damper and said extend chamber;

5) further reducing the pressure of the working fluid passing through the sequence valve until the sequence valve is actuated to an operating position wherein pressurized working fluid is no longer provided to said hydraulic motor, said large carriage index up hydraulic cylinder or said kickover assembly.

16. The method of claim 15 further including the step of:

6) increasing the pressure of the working fluid to a third predetermined pressure with said sequence valve in an operative position blocking the supply of pressurized working fluid to the motor, the large carriage index up hydraulic cylinder and the kickover assembly, until the lance extends from the lance guide with the high pressure working fluid jetting out of the lance.

17. The method of claim 16 further including 7) monitoring the flow of the pressurized hydraulic working fluid in step 5 to determine when the hydraulic motor is no longer running confirming the carriage assembly position and the axial position of the mill bit.

18. A well penetrator tool comprising:

1) an elongated support means positionable in a well casing having an axis and a casing inner surface for lowering down the casing to a desired depth;

2) carriage means mounted on said elongated support means for selective movement between an upper position and a lower position relative to said casing;

3) a driven rotary milling cutter mounted on said carriage for rotation about a cutter axis having a substantial component perpendicular to the axis of the casing and for inward and outward movement along said cutter axis so that outward movement results in the cutting of a casing opening in said casing by said milling cutter when said carriage is in its upper position; and 4) hose guide means on said carriage supporting the outer end of a movable hose having a nozzle on its outer end in alignment with said casing opening in response to said carriage being in its lower position whereby the hose can be extended outwardly through said casing opening while ejecting high pressure fluid from its nozzle end to cut a passageway into the surrounding formation.

19. A well penetrator tool as recited in claim 18 additionally including:

5) a motor mounted on said carriage below said hose guide means and having a power output shaft oriented substantially vertically; and 6) right angle drive means connecting said power output shaft to said driven rotary milling cutter for effecting rotation of said driven rotary milling cutter.

20. A well penetrator tool as recited in claim 19 additionally including:

7) a force exerting member connected to said rotary milling cutter for effecting outward movement of said rotary milling cutter while said rotary milling cutter is being rotated by operation of said motor.

21. A well penetrator tool as recited in claim 20 additionally including:

8) a power driven structure for selectively moving said carriage to either its upper position or its lower position.

22. A well penetrator tool as recited in claim 21 additionally including:

9) power actuated apparatus for selectively extending and retracting said movable hose means relative to said casing opening.

23. A well penetrator tool as recited in claim 22 wherein said motor, said force exerting member, said power driven structure and said power actuated apparatus are all powered by pressurized hydraulic fluid.

24. A well penetrator tool as recited in claim 23 additionally including:

10) a selectively pressure variable source of hydraulic work fluid; and 11) a hydraulic control circuit connecting said selectively pressure variable source of hydraulic work fluid to said motor, said force exerting member, said power driven structure and said power actuated apparatus.

* * * * *